US011149384B2

(12) United States Patent
Smith

(10) Patent No.: US 11,149,384 B2
(45) Date of Patent: Oct. 19, 2021

(54) PRECAST CONCRETE PANEL PATCH SYSTEM FOR REPAIR OF CONTINUOUSLY REINFORCED CONCRETE

(71) Applicant: The Fort Miller Co., Inc., Greenwich, NY (US)

(72) Inventor: Peter J. Smith, Gansevoort, NY (US)

(73) Assignee: The Fort Miller Co., Inc., Greenwich, NY (US)

( * ) Notice: Subject to any disclaimer, the term of this patent is extended or adjusted under 35 U.S.C. 154(b) by 0 days.

(21) Appl. No.: 16/443,271

(22) Filed: Jun. 17, 2019

(65) Prior Publication Data

US 2019/0382964 A1 Dec. 19, 2019

Related U.S. Application Data

(60) Provisional application No. 62/685,832, filed on Jun. 15, 2018.

(51) Int. Cl.
*E01C 11/14* (2006.01)
*E01C 5/00* (2006.01)
(Continued)

(52) U.S. Cl.
CPC ..... *E01C 5/005* (2013.01); *E01C 5/105* (2013.01); *E01C 11/005* (2013.01); *E01C 2201/16* (2013.01)

(58) Field of Classification Search
CPC ..... E01C 11/14; E01C 11/005; E01C 5/10; E01C 23/10; E01C 5/005; E01C 5/08;
(Continued)

(56) References Cited

U.S. PATENT DOCUMENTS 2,127,973 A * 8/1938 Isett ..... E01C 11/14 404/56
3,260,175 A * 7/1966 Crone ..... E01C 19/504 404/61

(Continued)

OTHER PUBLICATIONS

Continuously Reinforced Concrete Pavement: Extending Service Life of Existing Pavements (Publication No. FHWA-HIF-13-024, Apr. 2013, pp. 32-36). (Year: 2013).*

(Continued)

*Primary Examiner* — Brent W Herring
*Assistant Examiner* — Daniel J Kenny
(74) *Attorney, Agent, or Firm* — David B. Tingey; Bryant J. Keller; Kirton McConkie

(57) ABSTRACT

A CRCP repair system is provided. The repair system may comprise a precast pavement panel having one or more openings positioned in the bottom, side portions thereof, as well as reinforcing members embedded within the panel. The panel may also include a reinforcing fastening member extending into each of the openings. The repair system may further include a prepared side edge of the CRCP having reinforcing anchoring members epoxy cemented therein and extending therefrom, with the anchoring members configured to extend into the openings of the panel with the panel positioned in the void created by the removed CRCP. The anchoring members may be configured in a pair, with each pair positioned to extend into the opening, with the fastening member extending into the opening between the pair of anchoring members. Each of the fastening members and the anchoring members may have a head on a distal end thereof, with the heads configured to create opposing and overlapping forces within the opening when cementitious adhesive (such as grout) is inserted within the opening and cured.

22 Claims, 15 Drawing Sheets

(51) Int. Cl.
*E01C 11/00* (2006.01)
*E01C 5/10* (2006.01)

(58) Field of Classification Search
CPC ..... E01C 5/06; E01C 2201/12; E01C 11/06; E01C 5/003; E01C 7/147; E01C 11/02
USPC ..... 404/56, 58
See application file for complete search history.

(56) References Cited

U.S. PATENT DOCUMENTS 4,604,841 A * 8/1986 Barnoff ..... E01D 2/02 14/73
4,619,096 A * 10/1986 Lancelot, III ..... E04C 5/165 52/848
4,781,006 A * 11/1988 Haynes ..... E04B 1/215 52/583.1
4,883,385 A * 11/1989 Kaier ..... E01C 11/14 404/47
5,134,828 A * 8/1992 Baur ..... E04B 1/043 52/699
6,052,964 A * 4/2000 Ferm ..... E01C 11/14 52/742.14
6,065,263 A * 5/2000 Taguchi ..... E04B 5/023 403/305
6,086,288 A * 7/2000 Ruel ..... E02D 29/0241 405/262
6,758,924 B1 * 7/2004 Guijt ..... B29C 73/10 156/64
6,899,489 B2 * 5/2005 Smith ..... B28B 7/002 249/192
7,134,805 B2 * 11/2006 Yee ..... F16L 13/113 404/50
8,007,199 B2 * 8/2011 Shaw ..... E01C 19/504 404/60
8,128,312 B2 * 3/2012 Stuchell ..... E01C 5/223 404/43
8,636,441 B2 * 1/2014 French ..... B28B 7/186 404/45
8,756,898 B1 * 6/2014 Backhaus ..... E04B 5/023 404/47
8,911,173 B2 * 12/2014 Ulislam ..... E01C 5/005 404/17
9,546,454 B2 * 1/2017 Sanders ..... E01C 7/147
9,797,139 B2 * 10/2017 Savard ..... E04C 2/044
9,920,490 B2 * 3/2018 Sylvester ..... E01C 5/005
2004/0074183 A1 * 4/2004 Schneider, III ..... E01D 19/125 52/334
2014/0020321 A1 * 1/2014 Eklund ..... E04B 1/61 52/582.1
2015/0078822 A1 * 3/2015 Backhaus ..... E01C 5/06 404/47
2015/0167260 A1 * 6/2015 Siqueiros ..... E01C 5/06 404/73

OTHER PUBLICATIONS https://www.aggregateresearch.com/news/precast-concrete-patches-make-the-grade-on-ontario-highways, Apr. 11, 2012 (Year: 2012).*

* cited by examiner

PRECAST CONCRETE PANEL PATCH SYSTEM FOR REPAIR OF CONTINUOUSLY REINFORCED CONCRETE

CROSS-REFERENCE TO RELATED APPLICATION

This application claims priority to U.S. Provisional Application No. 62/685,832, which was filed on Jun. 15, 2018, and which is entitled PRECAST CONCRETE PANEL PATCH SYSTEM FOR REPAIR OF CONTINUOUSLY REINFORCED CONCRETE; the entire disclosure of which is hereby incorporated herein.

BACKGROUND

Technical Field

This disclosure relates generally to precast concrete, and in particular to the repair of continuously reinforced concrete (CRC) using precast concrete panels.

State of the Art

Continuously reinforced concrete pavement (CRCP) is a concrete pavement that is built in lanes that are generally between about 12 and about 24 feet wide, and in lengths that can extend thousands of feet (in some cases less and in some cases more). First, a subgrade surface is often prepared upon which closely-spaced (typically about 5 inches to about 9 inches) longitudinal steel rebar are placed at a proper distance (typically about 4 inches to about 6 inches) above the subgrade surface, depending upon the design thickness of the new pavement. Second and lastly, a concrete paver often deposits, extrudes, and finishes plastic concrete over the pre-placed rebar. A single day's operation may (in some cases) produce up to a few thousand feet of pavement, depending upon the efficiency of the construction crew. Unlike unreinforced concrete pavement, which is typically built with transverse joints every 15 feet or so apart, there are (generally speaking) no transverse joints in CRCP, which often makes it a smoother and longer lasting pavement. As freshly cast CRCP cures, however, it often shrinks and, by design, transverse cracks appear at about every 6-8 feet apart, with such cracks often being very small and being considered to be benign because of the presence of the longitudinal steel. In many cases, such curing stresses actually place the rebar in tension as the concrete surrounding the bars cures and tends to shrink. That tension often increases as ambient temperatures lower, placing more stress in the rebar as the CRCP attempts to shrink even more. The pavement is regularly designed with enough steel to safely resist these longitudinal thermal loads such that widths of the transverse cracks typically do not increase. This method of building jointless pavement, which was originally developed in the 1960's and 1970's, has been used heavily in many mid-west states with vast expanses of heavily traveled roadways—largely because such pavement originally exhibited the potential to provide long-term "zero-maintenance" service life under heavy traffic loadings and challenging environmental conditions. The justification for using this more costly type of pavement is largely based upon a common belief that CRCP may be considered a "premium pavement" and indeed, it seems to have earned that label.

Yet, after many years of successful service, it is now clear that CRCP is not necessarily maintenance free—at least not in some installations around the world. While the theory behind CRCP was and is sound, some batches of concrete placed during initial construction in such roadways were not up to proper standards—resulting in sections of concrete that failed over time under seasonal and environmental conditions. As a result, some CRCP is now badly in need of repair, especially on some heavily traveled interstates, such as I-10 in El Paso, Tex. In most cases, this need for repair is likely due to traffic counts and a percentage of truck traffic that far exceeds the weight limits for which the pavement was originally designed. Additionally, some of the needed repairs are the result of pockets of concrete pavement that were not durable.

By comparison, repair to CRCP is often much more challenging than repair to jointed pavement. For example, jointed pavement is generally relatively easy to repair because it is either lightly reinforced or not reinforced at all and is not appreciably longitudinally stressed, due to the short panel lengths. And, repairs to jointed concrete pavement using cast-in-place (CIP) concrete techniques have become commonplace and effective in most states. In the last 19 years or so, a majority of the states in the U.S. have been installing precast repair panels (in jointed pavement) that allow overnight installation in heavily traveled areas. On the other hand, the repair of CRCP is often much more involved and time-consuming due to the continuous longitudinal reinforcing steel (usually in the form of rebar) positioned at relatively narrow intervals within the concrete at the time of original construction. Thus, the removal of a distressed section of the CRCP necessarily requires cutting and interrupting the continuity of these purposefully-placed, continuous reinforcing means before any subsequent repair can take place.

In short, there is thus a need in the relative industry to design and implement a new and improved system and method for repairing CRCP. Accordingly, it would be an improvement in the art to augment or even replace current techniques with other techniques.

SUMMARY

The present disclosure relates to precast concrete, and in particular to the repair of continuously reinforced concrete or CRC using precast concrete panels.

An aspect of the present disclosure includes a repair system that includes a precast concrete panel having one or more openings positioned in at least a bottom side portion thereof, as well as one or more reinforcing members embedded within the panel. In some cases, the panel also includes a reinforcing fastening member extending into each of the openings. Some implementations of the repair system further comprise a prepared side edge of the continuously reinforced concrete pavement or CRCP having reinforcing anchoring members epoxy cemented (or otherwise secured) therein and extending therefrom, with the anchoring members being configured to extend into the openings of the panel with the panel positioned in a void created by the removal of existing CRCP. The anchoring members also serve to transfer vertical wheel loads and/or horizontal tensile loads from the precast panel to the CRCP or from the CRCP to the precast panel. The anchoring members, in some cases, are configured in a pair, with each pair positioned to extend into the opening, or (in some cases) are configured as single anchoring members, with the fastening member extending into the opening between the pair of anchoring members. In some cases, pairs of anchoring and load transfer members are used when repairing thin CRCP while larger single anchoring members are (in some cases) used when repairing thicker CRCP. In some implementations, one or more of the fastening members and the anchoring members optionally have a head on a distal end thereof, with the head being configured to create opposing and overlapping forces within the opening when cementitious adhesive (such as Portland Cement-based grout) and/or any other suitable binder is inserted within the opening and cured.

In some implementations, the described systems further include a pavement patch having a precast panel that has a first end, a second end that is disposed substantially opposite to the first end, a top surface, a bottom surface, and an opening defined in the precast panel such that the opening opens at both the first end and the bottom surface of the precast panel. In some cases, the described systems further include a piece of pavement (e.g., a piece of CRCP, another precast panel, and/or any other suitable form of pavement) having a first anchor (or anchoring) member that is anchored within the piece of pavement and that extends from a first face (e.g., a full-cut face, and/or any other suitable end surface) of the piece of pavement in a position such that the first anchor member extends from the piece of pavement into the opening when the first end of the precast panel is abutted against the first face of the piece of pavement and when the first anchor member and the opening are aligned.

In some such implementations, the described precast panel includes a distal end that is disposed at the first end of the precast panel and a proximal end that is disposed closer to a midpoint of a length between the first end and the second end of the precast panel than is the distal end of the opening, and wherein a wall of the opening extending between the distal end and the proximal end of the opening comprises a non-linear portion and/or any other suitable feature that is configured to capture a binder that is added to the opening.

Additionally, in some such implementations: the precast panel further comprises a strengthening member that is embedded within the precast panel and that runs adjacent to a side of the opening, a distal portion of the strengthening member includes a head, a distal portion of the first anchor member comprises a head, the precast panel further comprises a fastening member having a first portion that is embedded in the first panel and a second portion that extends into the opening, the second portion of the fastening member includes an enlarged head, the second portion of the fastening member has an elongated member that is coupled to the first portion of the fastening member after the first portion of the fastening member is embedded in the precast panel, the piece of pavement further includes a second anchor member that is anchored within the piece of pavement such that the second anchor member extends from the first face of the piece of pavement so that the first and second anchor members extend from the piece of pavement into the opening when the first end of the precast panel is abutted against the first face of the piece of pavement and the first and second anchor members are aligned with the opening, a distal portion of each of the first and second anchor members comprises an enlarged head, and/or a portion of each of the first and second anchor members runs substantially parallel to the second portion of the fastening member within opening when the first end of the precast panel is abutted against the first face of the piece of pavement.

Moreover, some implementations of the described system include a pavement patch that has a precast panel having a first end, a second end that is disposed substantially opposite to the first end, a top surface, a bottom surface, an opening defined in the precast panel such that the opening opens at both the first end and/or second ends, as well as at the bottom surface of the precast panel, and a fastening member having a first portion that is disposed and coupled within the precast panel and a second portion that extends from the first portion into the opening, wherein the second portion comprises a head. In some such implementations, the system further includes a piece of continuously reinforced pavement (and/or any other suitable pavement) having a first anchor member that is anchored within the piece of continuously reinforced pavement and that extends from a first face of the piece of continuously reinforced pavement in a position so that a portion of the first anchor member extends from the piece of continuously reinforced pavement into the opening when the first end of the precast panel is abutted against the first face of the piece of continuously reinforced pavement and when the first anchor member and the opening are aligned, wherein the portion of the first anchor member that extends from the piece of continuously reinforced pavement into the opening comprises an enlarged head. In some such implementations, the first portion and the second portion of the fastening member are threadedly coupled together; a portion of the top surface extends over both the opening and the second portion of the fastening member, wherein the precast panel defines an inlet that allows a binder to be introduced into the opening through the top surface; the opening in the precast panel comprises a distal end that is disposed at the first end of the precast panel and a proximal end that is disposed closer to a midpoint of a length between the first end and the second end of the precast panel than is the distal end, and wherein a wall of the opening extending between the distal end and the proximal end of the opening defines a recess that is configured to receive a binder that is added to the opening; and/or the precast panel further comprises a first strengthening member and a second strengthening member that are each embedded within the precast panel and that each run adjacent to, and flank, an opposite side of the opening.

In some other implementations, the described methods include a method for patching pavement, wherein the method includes providing a precast panel having a first end, a second end that is disposed substantially opposite to the first end, a top surface, a bottom surface, and an opening defined in the precast panel such that the opening opens at both the first end and the bottom surface of the precast panel; obtaining a piece of pavement having a first anchor member that is anchored within the piece of pavement and that extends from a first face of the piece of pavement; and coupling the precast panel with the piece of pavement such that the first anchor member extends from the piece of pavement into the opening such that the first end of the precast panel is abutted against the first face of the piece of pavement and such that the first anchor member is aligned with the opening. In some such implementations, the precast pavement panel defines an orifice that is open from the top surface and first end, and wherein the compression device is disposed in the orifice.

Some implementations related to a method for patching pavement, the method that includes providing a precast pavement panel having: a first end, a second end that is disposed substantially opposite to the first end, a top surface, and a bottom surface; and a fastening member that is coupled to the precast pavement panel and that extends from the first end of the precast pavement panel; obtaining a piece of pavement having an anchor member that is anchored within the piece of pavement and that extends from a first face of the piece of pavement; aligning the first end of the precast pavement panel with the first face of the piece of pavement to form a space between the precast pavement panel and the piece of pavement such that a length of the fastening member extends past a length of the anchor member within the space between the precast pavement panel and the piece of pavement; and applying a binder into the space between the precast pavement panel and the piece of pavement to bind the precast pavement panel with the piece of pavement.

Some implementations relate to a precast pavement panel having: a first end, a second end that is disposed substantially opposite to the first end, a top surface, and a bottom surface; and an opening defined in the precast pavement panel such that the opening opens from at least one of the first end, the bottom surface, and the top surface of the precast pavement panel, wherein the opening is configured to resist vertical and horizontal loads imposed upon a binder material placed therein.

Moreover, some implementations relate to a pavement patch system that includes: a precast pavement panel having: a first end, a second end that is disposed substantially opposite to the first end, a top surface, and a bottom surface; and a fastening member embedded in the precast pavement panel and that extends beyond the first end; and an anchor member that is anchored within a piece of pavement and that extends from a first full-depth face of the piece of pavement, wherein when the first end of the precast pavement panel is aligned with the first face of the piece of pavement, a full-depth space is formed between the first end of the precast pavement panel and the first face of the piece of pavement, the anchor member extends from the first face of the piece of pavement into the full-depth space and the fastening member extends from the first end of the precast pavement panel into the full-depth space.

In some cases, the described systems and methods include using multiple precast panels of pavement. In such cases, the precast panels can be assembled together in any suitable manner, including, without limitation, being disposed end to end, side by side, kitty corner to each other, and/or in any other suitable manner. Additionally, in some cases, the described anchor members and/or fastening members are configured to not only transfer vertical loads (e.g., wheel loads) between the CRCP and the precast panel (or vice versa), but they are also configured to transfer horizontal tensile loads between each other. In this regard, while most of the compressive loads in the described systems are carried by concrete, in some cases, the internal supports (e.g., the anchor members, the strengthening members, the fastening members, etc.) also help carry the compressive forces. Moreover, while an end face of existing CRCP is often cut with a saw for use with some implementations of the described systems and methods, in some other implementations, the end of the existing CRCP that is to be joined with one or more of the described precast panels is relatively rough (e.g., being cut or broken with a chisel, jack hammer, saw, hammer, bucket, explosive, and/or in any other suitable manner).

These and other features and advantages of the present systems and methods will be set forth or will become more fully apparent in the description that follows and in the appended claims. The features and advantages may be realized and obtained by means of the instruments and combinations particularly pointed out in the appended claims. Furthermore, the features and advantages of the described systems and methods may be learned by the practice of the invention or will be obvious from the description, as set forth hereinafter.

BRIEF DESCRIPTION OF THE DRAWINGS

In order that the manner in which the above-recited and other features and advantages are obtained, a more particular description of the described systems and methods will be rendered by reference to specific embodiments thereof, which are illustrated in the appended drawings. Understanding that the drawings are not necessarily drawn to scale or in proper proportion, and that the drawings depict only typical embodiments and are not, therefore, to be considered as limiting the scope of this application. Any labels, text, measurements, dimensions, notes, and/or other information provided in the Figures are provided for illustration purpose and are no to be considered to be limiting in any way. The present embodiments will be described and explained with additional specificity and detail through the use of the accompanying drawings, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., which are disclosed simply as examples of embodiments of the present disclosure.

As a preface to the detailed description, it should be noted that, as used in this specification and the appended claims, the singular forms "a", "an" and "the" include plural referents, unless the context clearly dictates otherwise.

Figure 1:
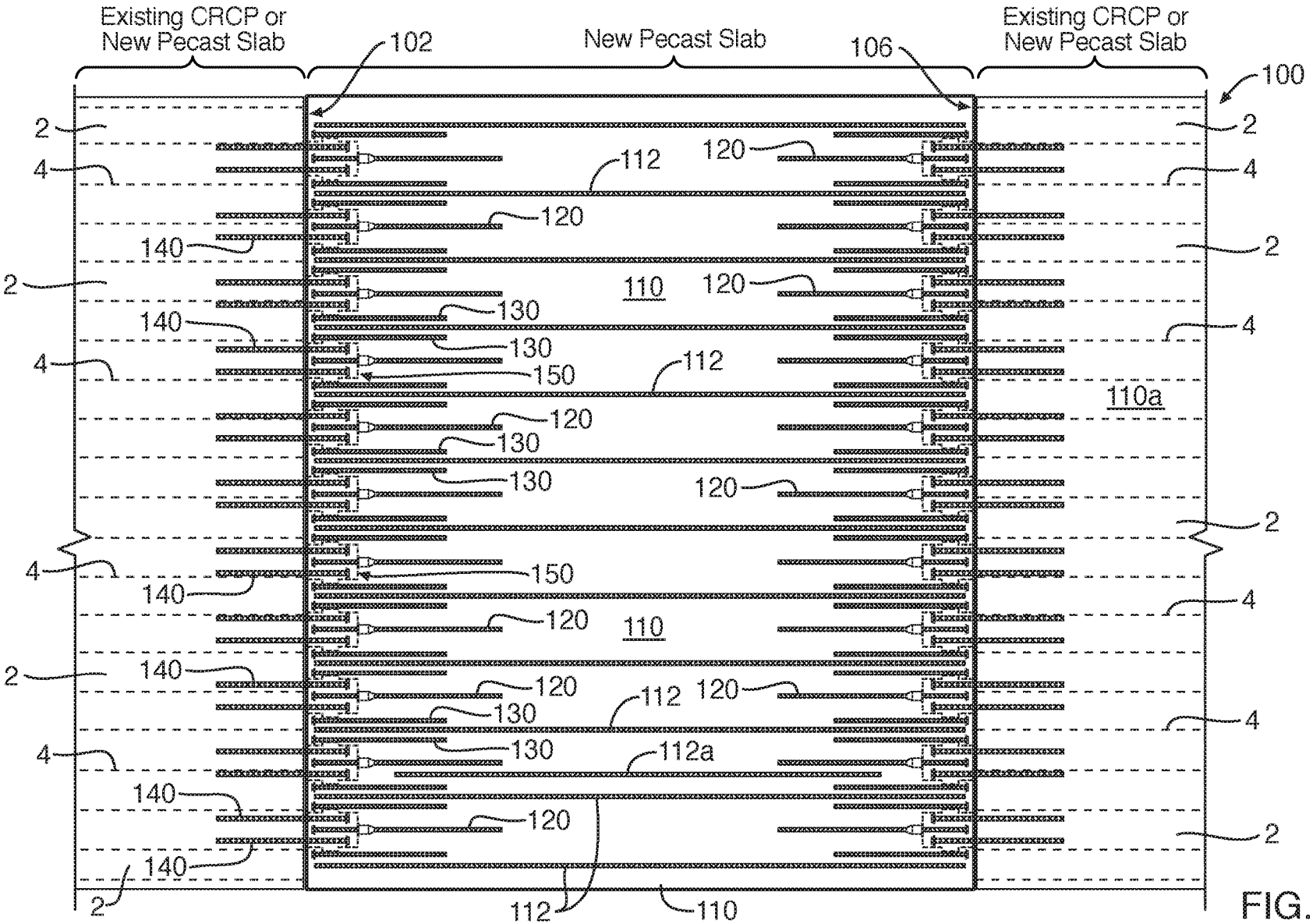
FIG. 1 depicts a see-through, plan view of an embodiment of a precast concrete panel repair system for repair of CRCP, in accordance with the present disclosure.

Referring to the drawings, FIG. 1 depicts an embodiment of a precast concrete panel repair system 100 for repair of continuously reinforced concrete pavement (CRCP) 2. Embodiments of the system 100 can comprise various structural and functional components that complement one another to provide the unique functionality, performance, and methodology of the system 100, the structure, function, and method of which will be described in greater detail herein.

Some embodiments of the system 100 comprise one or more precast panels of pavement 110. In this regard, some precast pavement panels, such as panel 110, comprise preformed sections of concrete (i.e., any suitable type of concrete, ashcrete, hemperete, ferrock, timbercrete, polymer concrete, limecrete, glass concrete, cement, rubber tire aggregate concrete, fiber-reinforced concrete, Portland cement, pre-stressed concrete, high-density concrete, lightweight concrete, air entrained concrete, high performance concrete (HPC), ultra-high performance concrete (UHPC), and/or any other suitable form of concrete), ceramic, molded asphalt, and/or any other suitable concrete substitute and/or type of pavement material or materials that are prefabricated offsite in controlled conditions and thereafter delivered to the job site, fully cured and ready to be installed in the desired positions. Indeed, in some embodiments, one or more of the panels 110 comprise concrete. In such embodiments, such a panel 110 can be prepared using a concrete mixture having a predetermined consistency, strength, compressive strength, tensile strength, rigidity, density, coefficient of thermal expansion, thermal conductivity, elasticity, creep, and/or any other suitable characteristic of concrete. Moreover, the panel 110 can have any desired length, width, depth, and/or other measurement. Indeed, the panel 110 can be constructed to have any suitable thickness, including, without limitation, a depth that is between about 1" and about 24", or within any subrange thereof (e.g., between about 8" and about 12"), depending on conditions of the existing roadway (i.e., CRCP 2 and/or other existing pavement 2) with which the panel 110 will be coupled, united, mated, and/or otherwise joined.

Figure 5A:
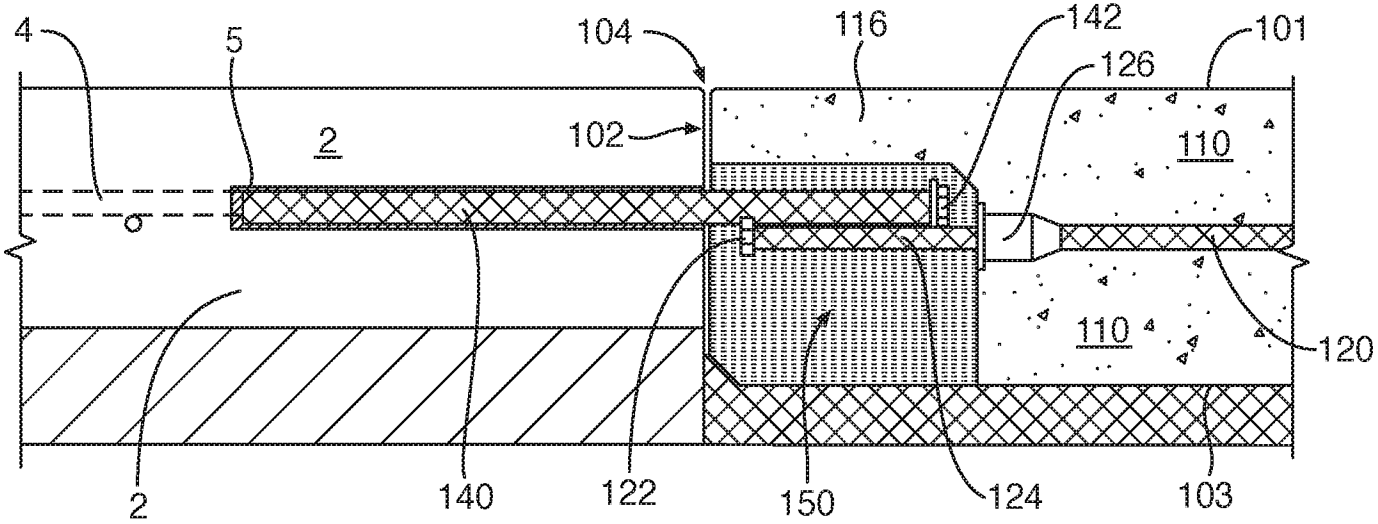
FIG. 5A depicts a cross-sectional, partial side view of the embodiment of the precast concrete panel repair system of FIG. 1, in accordance with the present disclosure.

In accordance with some embodiments, the panel 110 comprises a top surface 101 and an opposing bottom surface 103 (see e.g., FIG. 5). In this regard, some embodiments of the bottom surface 103 are configured to contact or engage a base, such as a pre-graded aggregate surface, a pre-finished concrete surface, and/or any other suitable surface when the panel 110 is placed in the opening of the CRCP 2 (and/or any other suitable existing pavement 2). Once placed, some embodiments of the top surface 101 are configured and positioned to receive vehicular and/or other automotive traffic thereon.

In some embodiments, the panel 110 also comprises a first side face 102 or end and a second side face 106 or end (see e.g., FIG. 1) that are substantially orthogonal (and/or at any other suitable angle) to the top and bottom surfaces 101 and 103. In this regard, some embodiments of the first and second side faces 102 and 106 are sized, shaped, smoothed, roughened, surfaced, and/or otherwise configured to match, cooperate with, abut, contact, reside nearby, be joined to, and/or otherwise collaborate with one or more side edge surfaces of the CRCP 2 (including, without limitation, one or more pieces of CRCP 2) created by full-depth saw cuts (and/or any other suitable type of cuts and/or surface) in the CRCP 2 during the removal process thereof (e.g., during the removal of damaged or faulty CRCP 2 that is to be replaced). Moreover, in accordance with some embodiments, the full-depth saw cuts (and/or other suitable cuts) in the CRCP 2 are sized, shaped, smoothed, roughened, surfaced, and/or defined to substantially match the existing dimensions of one or more panels 110. The point at which either of the side faces 102 or 106 of one or more panels 110 cooperates with the one or more pieces of the existing CRCP 2 (and/or any other suitable piece of pavement, including, without limitation, one or more other panels) may be considered a type of contact point, seam, junction, and/or joint 104.

Figure 8A:
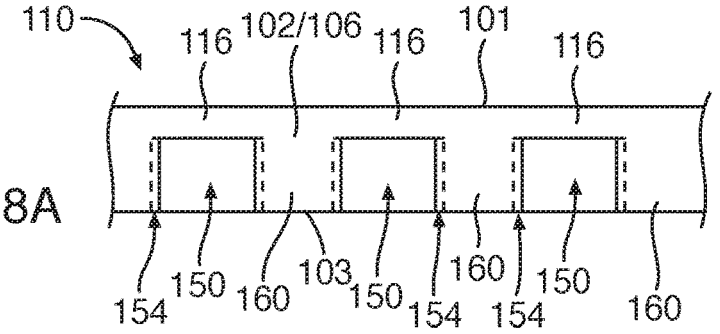
FIGS. 8A-8B each depict a see-through, partial end or side view of an embodiment of a precast concrete panel repair system for repair of CRCP, in accordance with the present disclosure.
Figure 8B:
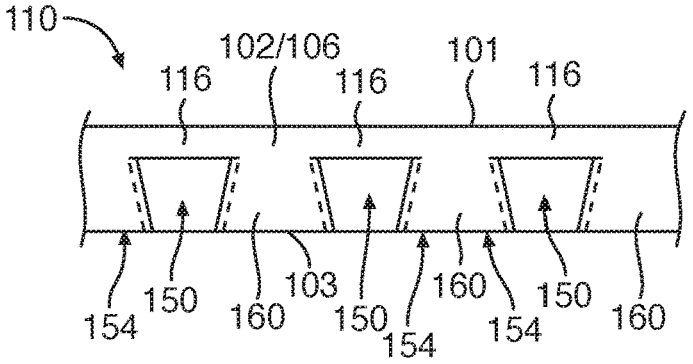
Figure 8C:
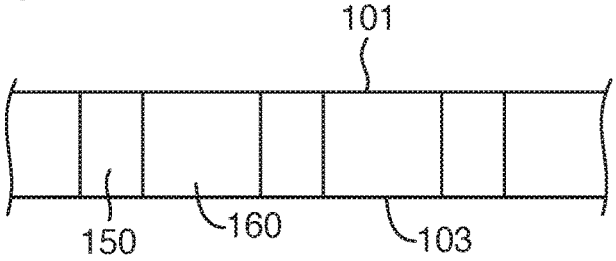
FIG. 8C depicts an end elevation view of an embodiment of the precast concrete panel repair system, in accordance with the present disclosure.

In accordance with some embodiments, the panel 110 further comprises one or more enveloping slots or openings 150 in one or more of the side faces 102 and 106, the top surface 101, the opposing bottom surface 103, and/or in any other suitable portion of the panel 110. Indeed, FIGS. 1, 4, 5, 6, and 8A-8B show some embodiments in which one or more of the openings 150 is defined in (and is disposed at) an end of the panel 110 so as to open from at least one of the side faces (e.g., side face 102) and the bottom surface 103 of the panel 110. Additionally, FIG. 8C shows a representative embodiment in which one or more of the openings 150 are defined in (and disposed at) an end of the panel 110 so as to open from each of a side face (e.g., side face 102), the bottom surface 103, and the top surface 101 of the panel 110.

The openings 150 can have any suitable characteristic that allows them to be filled with an epoxy, cement, grout, urethane, polyester grout or concrete, resin-based concrete, and/or any other suitable binding material (or binder) that is configured to bind the panel 110 to a corresponding piece of existing pavement (e.g., CRCP 2). Indeed, in some embodiments, the openings 150 are configured or spaced apart at regular intervals, at irregular distances, at corners of the panel 110, and/or as otherwise desired, along one or more of the side faces 102 and 106 (and/or in any other suitable location), with an intermediate concrete (and/or any other suitable material) section 160 positioned between neighboring openings 150.

The openings 150 can have any suitable dimensions that allow the openings 150 to accommodate one or more headed bars (e.g., fasteners 120, anchor members 140, etc.) and to be filled with an epoxy, cement, grout, urethane, polyester grout or concrete, resin-based concrete, and/or any other suitable binding material to bind the panel 110 to a corresponding piece of existing pavement 2. In this regard, some embodiments of the openings have a width of between about 1" and about 16" (or within any subrange thereof), a tallness measured form the bottom surface 103 of between about 1" and about 15" (or within any subrange thereof), and/or a depth measured from a corresponding face (e.g., one of the faces 102 or 106 at a distal end of the opening to a proximal-most portion of the opening, or to the portion of the opening 110 that is closest to a central point between the two faces of the panel 110) of between about 4" and about 16" (or within any subrange thereof). Indeed, in accordance with some embodiments, the openings 150 have a width of between about 2.5" and about 12", a tallness measured from the bottom surface 103 of between about 4" and about 10", and a depth measured from the faces 102 or 106 of between about 7" to about 12". In particular, some embodiments of the panel 110 have openings 150 that comprise a width of about 6", a tallness of about 7.5", and a depth of about 9", such that the openings 150 are not too large to weaken the structural integrity of the panel 110 but are yet large enough to allow the panel 110 to sufficiently couple to the existing CRCP, as will be described herein.

Figure 6:
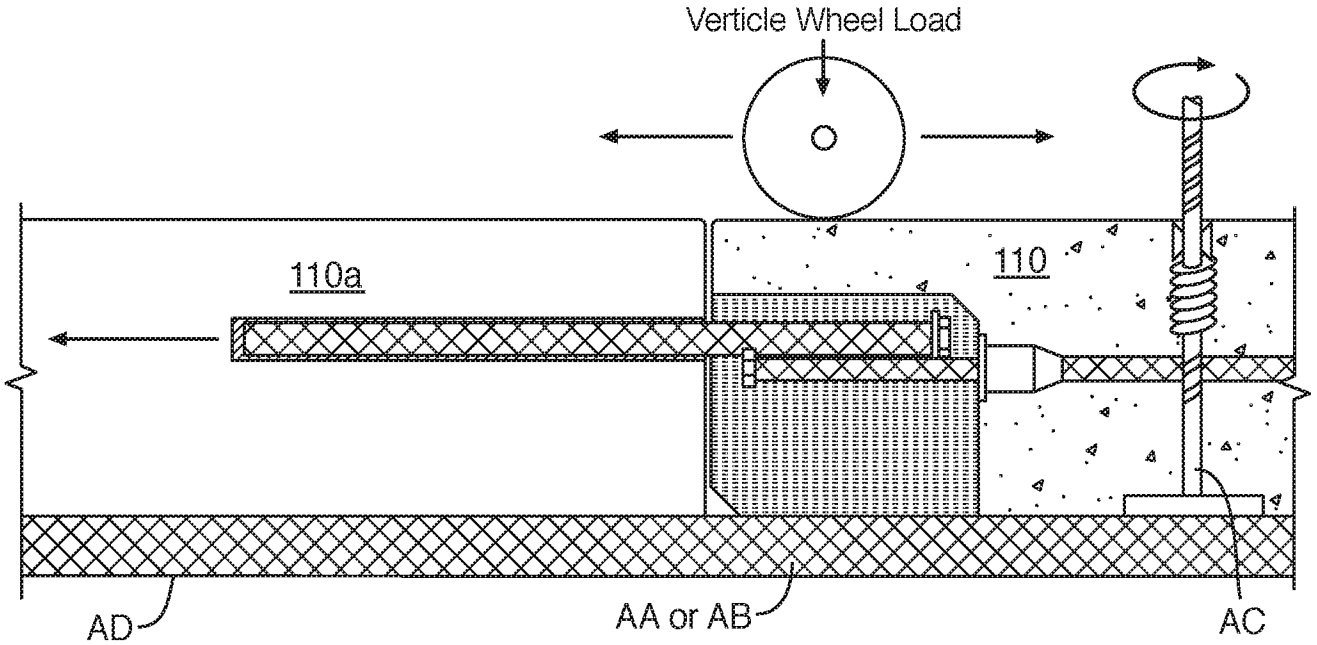
FIG. 6 depicts a cross-sectional, partial side view of the embodiment of the precast concrete panel repair system of FIG. 5 showing application of vertical wheel loads and embedded leveling lifters, in accordance with the present disclosure.

The openings 150 can have any suitable shape (e.g., internal shape) that allows them to be filled with an epoxy, cement, grout, urethane, polyester grout or concrete, resin-based concrete, and/or any other suitable binding material to bind the panel 110 to a corresponding piece of existing pavement 2. In accordance with some embodiments, the sides of the openings 150 are vertical as shown in FIG. 8A. In accordance with some other embodiments, FIG. 8B shows that the sides of one or more of the openings (or at least a portion of the openings 150 have sides) that are non-vertical (e.g., to create a dove-tail shape wherein the top width is greater than the bottom width), thus rendering the opening 150 more effective in resisting vertical wheel loads as shown in FIG. 6. In other words, in some embodiments, any grout, concrete, cement, epoxy, cementitious adhesive material, and/or any other suitable binding material eventually filling the opening 150 takes the form of a wedge, due to the dove-tail shaped opening that resists being pushed out of an opening smaller than the wide part of the wedge.

As described above, the openings 150 can open from any suitable portion of the panel 110, including, without limitation, one or more of the side faces 102 and 106, the top surface 101, the opposing bottom surface 103, and/or any other suitable portion of the panel 110. In some embodiments, however, the openings 150 are configured to open to the bottom surface 103, but not the top surface 101 (or, said differently, a portion of the top surface 101 extends over the opening 150). For example, the panel 110 may have a concrete portion 116 (e.g., as shown in FIG. 5) thereof defining a cap, lid, and/or other barrier over the openings 150, such that one or more of the openings 150 do not open up directly to the top surface 101. However, in some embodiments, the concrete portions 116 have one or more holes therein (e.g., shown as 117 in FIG. 18A) that allow communication from the top surface 101 into the openings 150, such that grout, concrete, epoxy, sealant, and/or any other suitable fixing or binding material can be inserted through the holes 117 to fill the openings 150 and to thereby secure the panel 110 in place with respect to the CRCP 2 (and/or any other suitable piece of pavement).

Figure 17B:
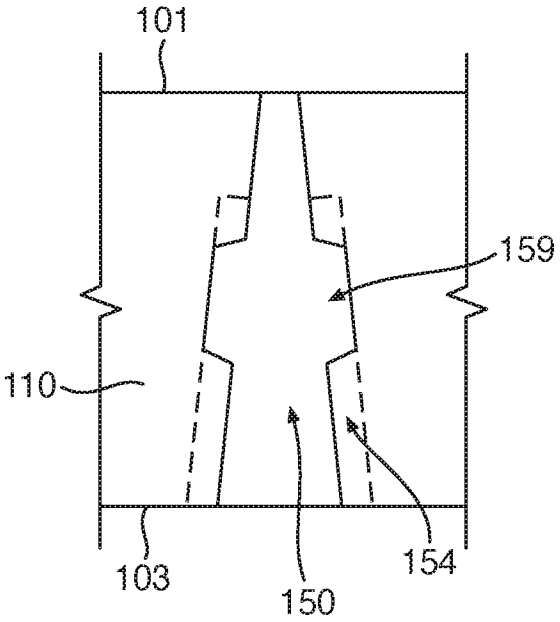
FIG. 17B depicts a partial side view of an embodiment of a precast concrete panel repair system, in accordance with the present disclosure.
Figure 17A:
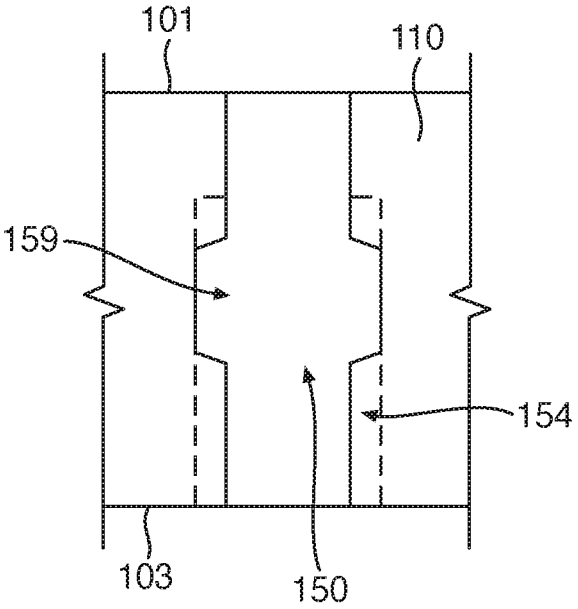
FIG. 17A depicts a partial side view of an embodiment of a precast concrete panel repair system, in accordance with the present disclosure.

In some embodiments, one or more of the openings 150 open directly to the top surface 101, as shown in FIGS. 17A and 17B. While such openings 150 can have any suitable characteristic, in some embodiments, the openings 150 run part of a (or the entire) height or tallness of the panel 110. Indeed, in some embodiments, one or more of the openings 150 run the entire height or tallness of the panel 110 such that the openings 150 are open to (or from) both the top surface 101 and the bottom surface 103.

Moreover, in accordance with some embodiments, one or more of the openings 150 have one or more keyways having any suitable orientation, including, without limitation, being substantially horizontal, vertical, diagonal, and/or having any other suitable orientation and/or shape (e.g., narrowed portions that lock solidified binder within the opening, and/or any other suitable shape). Indeed, in some embodiments, one or more of the openings 150 define a substantially horizontal keyway 159 in one or more side wall surfaces of the opening 150 (e.g., as depicted in FIG. 17A) in addition to (and/or in place of) the recess 154 described below to resist vertical wheel loads placed upon the panel as shown in FIG. 11B.

Also, in addition to (or in place of) any keyways 159, the side wall surfaces of the openings 150 can have any other suitable characteristic, including, without limitation, being substantially vertical, angled, comprising one or more protrusions, comprising one or more recesses, and/or having any other suitable characteristic. Indeed, in accordance with some embodiments, one or more of the side wall surfaces of the opening 150 are angled with respect to the vertical, as depicted in FIG. 17B, such that the width and/or size of the open end of the opening 150 to the top 101 surface is greater than or smaller than the size of the open end of the opening 150 to the bottom surface 103. In yet other embodiments, not depicted, the openings 150 may directly open to a side or end surface and may be configured as a center slot, an oversized center hole not open to the top surface 101 or the bottom surface 103 except for small diameter and/or width ports (e.g., 117) that may allow injection of cementitious adhesive or any other suitable binding agent, a full depth slot, and/or any other cavity or opening provided in the panel 110 into which a reinforcing member may be inserted and grouted over (or otherwise be bound).

With reference again to FIG. 1, the panel 110 may further comprise one or more cross members 112 positioned and embedded within the panel 110 and configured to run across the width, or a substantial portion (e.g., as shown by cross member 112*a*) of the width (and/or a length), from the first side face 102 to the second side face 106. Indeed, in accordance with some embodiments, one or more cross members 112 are positioned within the panel 110 such that each opposing end of each cross member 112 extends into the intermediate concrete section 160 on opposing sides 102 and 106 of the panel 110. In some embodiments, the cross member 112 may be configured to extend substantially down the middle of the intermediate concrete section 160.

The cross members 112 may be comprised of, for example, any suitable material that allows them to strengthen the panel 110 (e.g., one or more intermediate concrete sections 160). Indeed, in some embodiments, the cross members 112 comprise one or more pieces of rebar, deformed rebar, fiberglass, metal, sheets, bars, rods, and/or any other suitable rigid materials that exhibit or demonstrate sufficient tensile capacity to maintain the tensile force transferred to them, by the means described herein, including, without limitation, from rebar 4 embedded within the existing CRCP 2 (see e.g., FIGS. 1, 2, 3, and 5). Further in example, when rebar is used as the cross members 112, the rebar may have any suitable bar size, including, without limitation, from #1 to #15 (or within any size in that range). Indeed, in some embodiments, the cross members 112 comprise rebar having a size from #5 to #10, although other bar sizes are contemplated. In some embodiments, satisfactory tensile strength and the required pullout strength are realized using rebar of size #6 in the precast panel 110, while a headed rebar of size #8 (and/or any other suitable size) may be epoxy anchored (and/or otherwise coupled) in the exposed side face of the CRCP 2.

Figure 2:
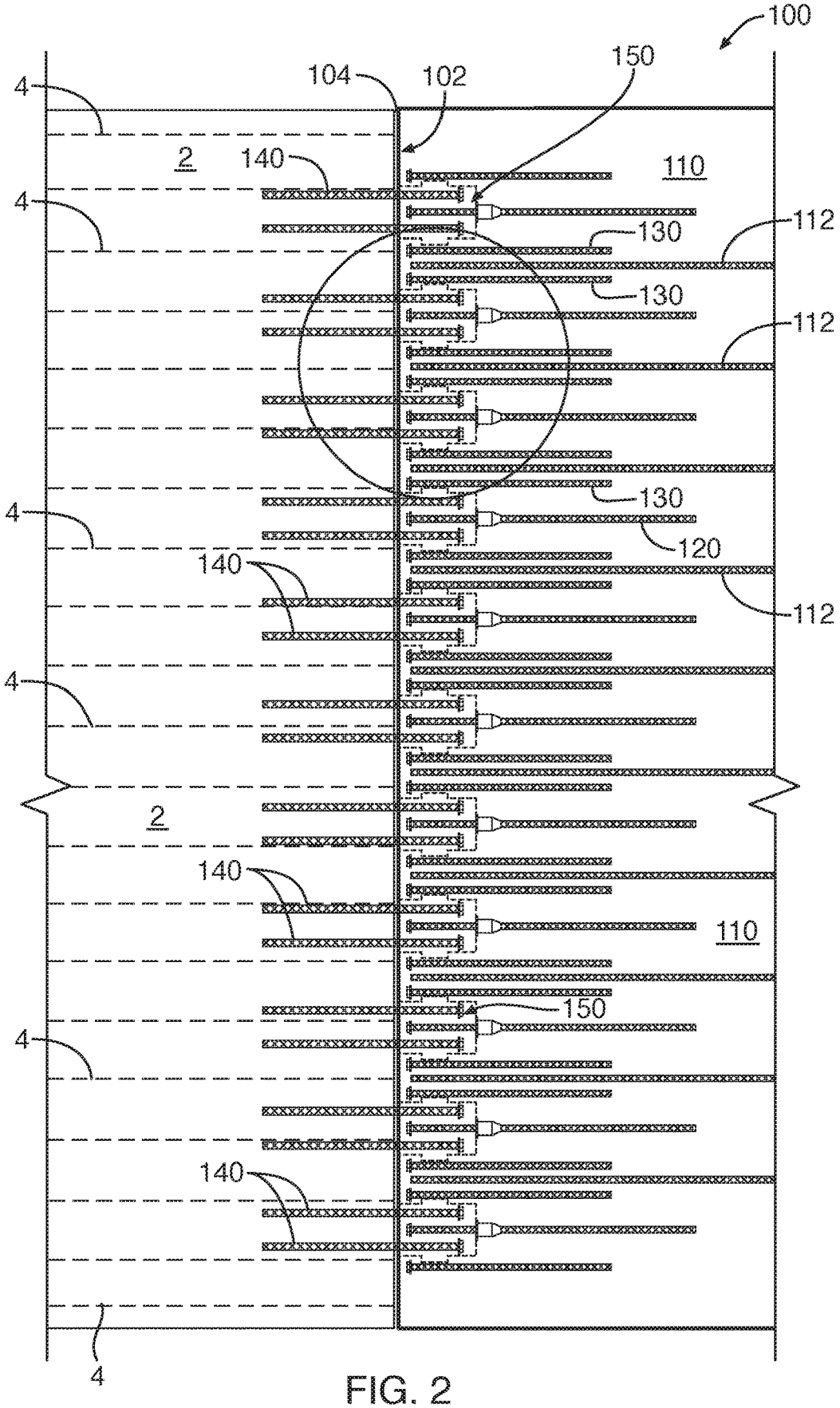
FIG. 2 depicts a see-through, partial plan view of the embodiment of the precast concrete panel repair system of FIG. 1, in accordance with the present disclosure.
Figure 4:
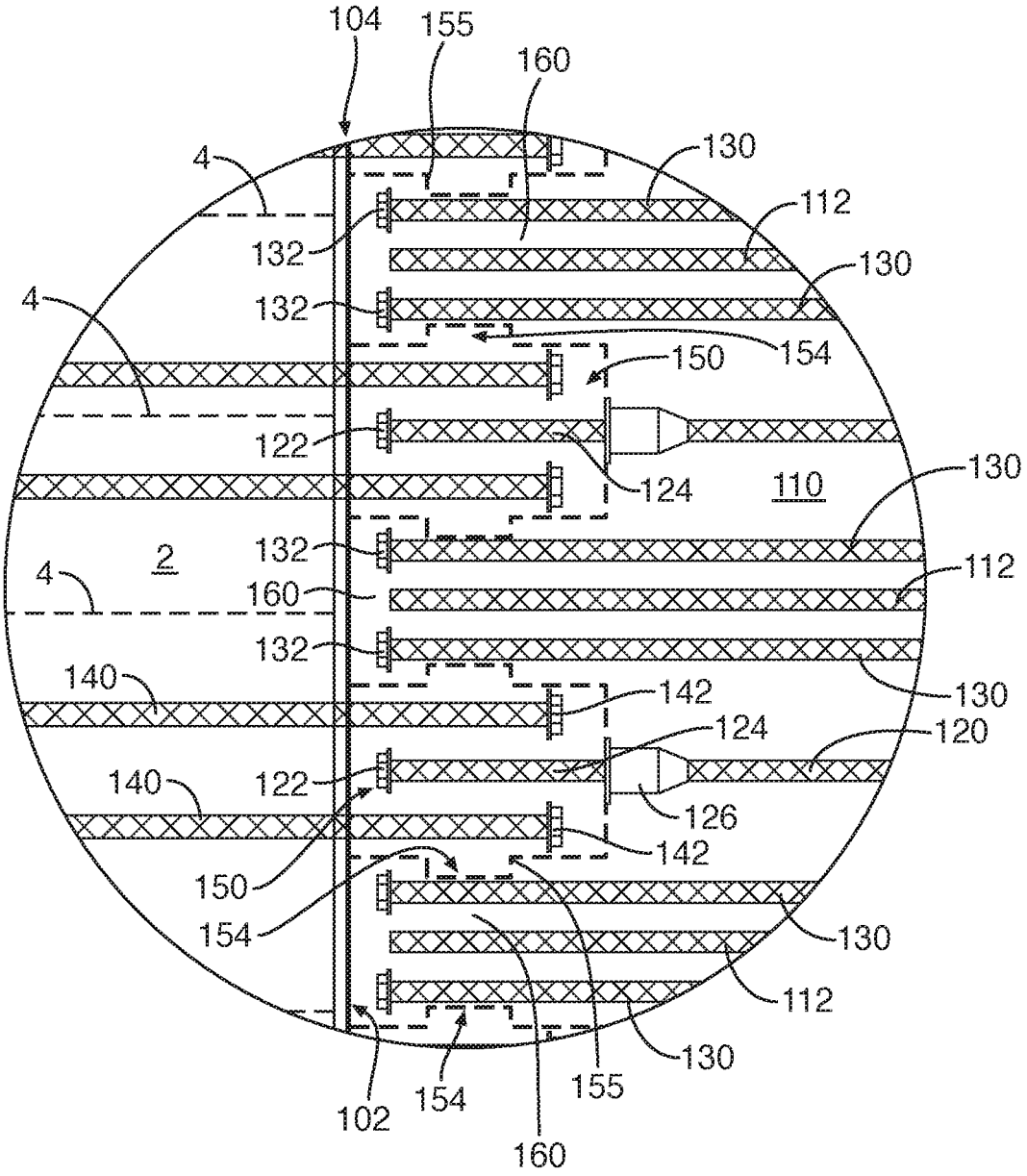
FIG. 4 depicts a see-through, partial plan view of the embodiment of the precast concrete panel repair system of FIG. 1, in accordance with the present disclosure.

With reference to at least FIGS. 1, 2, and 4, some embodiments of the panel 110 further comprise one or more fastening members 120 positioned and embedded within (and/or otherwise coupled within) the panel 110 and configured to have a portion or a segment 124 coupled to it and/or that extends out of the panel 110 and into the opening 150 but not (in some embodiments) beyond the opening 150. While such fastening members 120 and/or segments 124 can have a relatively constant diameter or width, in some embodiments, one or more fastening members 120 alternatively comprise one or more heads 122 thereon positioned at the distal end (and/or at a distal portion) of the fastening member 120 (and/or a segment) that extends into the opening 150. In other words, in some embodiments, the head 122 is configured on the distal end of the fastening member 120 and/or segment 120 and is positioned within the opening 150.

In this regard, the head 122 can have any suitable characteristic that helps ensure that the fastening member is tightly bound to the binding material. Indeed, in some embodiments, the head comprises one or more enlarged portions (e.g., a circular, quadrilateral, triangular, disc-shaped, perpendicular rod, protrusion, bulbous, and/or any other suitable shape) having a diameter, bend, shape, and/or size that is greater (or sufficiently different than) than the diameter of the shaft of the fastening member 120.

The fastening member 120 (and/or segment 124) can extend into any suitable portion of a corresponding opening 150. In some embodiments, however, the fastening member 120 is configured to extend into the opening 150, substantially down the middle of the opening 150. In other embodiments, two or more fastening members 120 (and/or segments 124) are configured to extend into the opening 150, so as each be off centered, or to be disposed in any other suitable location.

The fastening member 120 may be configured to have any suitable length that allows it to be coupled to the panel 110 and to extend into the opening 150, including without limitation, a length between about 12" and about 200" (or within any subrange thereof). Indeed, in some embodiments, the fastening member comprises a length between 24" and 36" with about 4" to about 12" (or any subrange thereof, e.g., between about 6" and about 8" thereof) extending into the opening 150. For instance, some embodiments of the fastening member 120 have a length of about 32", with about 24" being embedded within (and/or otherwise being coupled to) the panel 110 and the remaining 8" extending into the opening 150. In accordance with some embodiments, the presence of the head 122 allows at least the length of the fastening member 120 to be in the range of about 24", and shorter than other conventional anchors, because the head 122 develops tensile strength from/by the fastening member 120 within the concrete of the system 100 over shorter distances.

The fastening members 120 can also have any other suitable characteristic. By way of non-limiting example, in some embodiments, fastening members 120 on opposite ends of the precast panel 110 are spliced with (or otherwise coupled to) cross members 112 to directly transfer tensile force (and/or any other suitable force) between fastening members 120 in the same panel.

The fastening members 120 can comprise any suitable material that allows them to function as described herein. Indeed, in some embodiments, the fastening materials 120 comprise one or more pieces of rebar, deformed rebar, metal, a plate, a rod, and/or any other suitable rigid materials that exhibit or demonstrate sufficient tensile capacity to maintain the tensile force (and/or other forces) transferred to it by means described herein (e.g., from rebar 4 embedded within the existing CRCP 2). Further in example, when rebar is used as the fastening member 120, the rebar can be any suitable size, including, without limitation, being from size #1 to size #15, including any size therein. Indeed, in some embodiments the rebar acting as the fastening member 120 has a bar size of from #5 to #10, although other bar sizes are contemplated. In some embodiments, satisfactory tensile strength and the required pullout strength can be realized using rebar of size #6 (or any other suitable size) in the precast panel 110, while a rebar of size #8 (or any other suitable size) can be epoxy anchored (and/or otherwise coupled) in the exposed side face of the CRCP 2.

Figure 3:
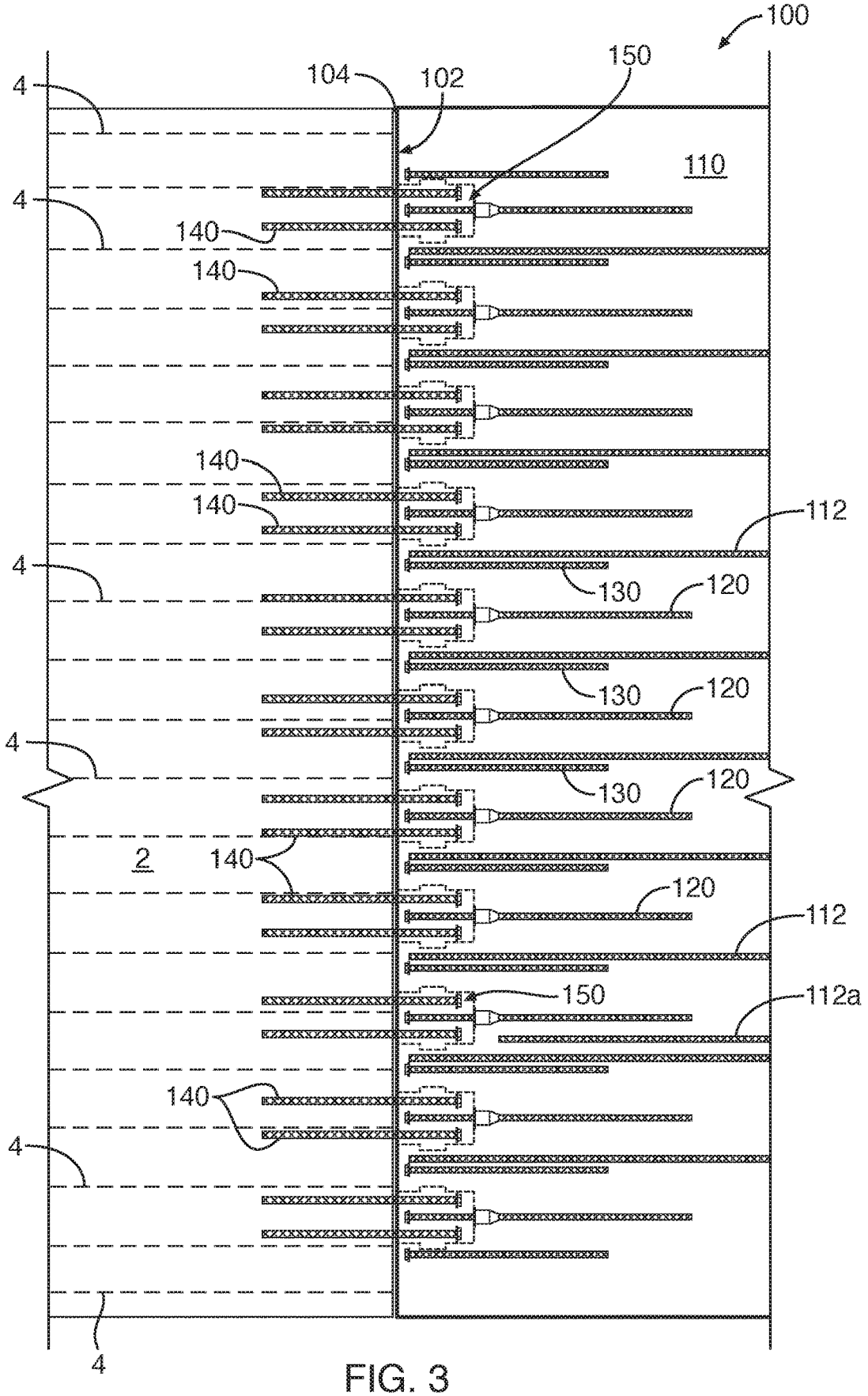
FIG. 3 depicts a see-through, partial plan view of an embodiment of a precast concrete panel repair system for repair of CRCP, in accordance with the present disclosure.

In some embodiments, the panel 110 further comprises one or more strengthening members 130 positioned and embedded within the panel 110. In some such embodiments, each strengthening member 130 is positioned within the panel 110 such that at least a portion of the strengthening member 130 extends into the intermediate concrete section 160 positioned between neighboring openings 150. In some embodiments, the strengthening members 130 are also configured such that at least one strengthening member 130 is positioned on each opposing lateral side of the cross member 112 within the intermediate concrete section 160. In other words, in some embodiments of the panel 110, a strengthening member 130 resides on either side of the cross member 112, such that two or more strengthening members 130 and one or more cross members 112 are all positioned within the intermediate concrete section 160 (e.g., as depicted in FIG. 2). Alternatively, in some embodiments of the panel 110, a single strengthening member 130 resides alongside the cross member 112, such that one strengthening member 130 and one cross member 112 are positioned within the intermediate concrete section 160 (e.g., as depicted in FIG. 3). In accordance with some embodiments, the strengthening members 130 serve to capture horizontal (and/or any other suitable) forces from headed anchor members 140 embedded in adjacent opening 150 so they can be transferred to cross members 112.

With reference again to at least FIGS. 1, 2, and 4, in some embodiments of the panel 110, the distal end of the strengthening member 130 (or the end closest to the first 102 or second 106 end of the panel 110) that is positioned within the intermediate concrete section 160 can also have configured thereon a headed portion or a head 132. The head 132 may be an enlarged portion (such as a circular, quadrilateral, triangular, disc, bend, deformation, bulbous, and/or any other suitable shape) having a diameter, shape, bend, and/or size greater (or sufficiently different) than the diameter of the shaft of the strengthening member 130. In some embodiments, the respective heads 132 of the strengthening members 130 terminate, or are positioned, at substantially the same distance from the respective side face 102 or 106 of the panel 110 as is the distal end of the cross member 112 positioned there between.

The strengthening member 130 can have any suitable length that allows it to function as described herein, including, without limitation, being between about 6" and about 50", or within any subrange thereof. Indeed, in some embodiments, the strengthening member is configured to have a length of between 18" and 30" with all of the strengthening member 130 being enveloped or encompassed within the panel 110. In some embodiments, one or more of the strengthening members 130 in the panel have a length of about 24". The presence of the head 132, in some embodiments, allows at least the length of the strengthening member 130 to be in the range of about 24", and shorter than other conventional reinforcing members, because the head 132 develops tensile strength from/by the strengthening member 130 within the concrete of the system 100 over shorter distances.

The strengthening members 130 can comprise any suitable material that allows it to function as described herein. Indeed, in some embodiments, it comprises one or more pieces of rebar, deformed rebar, metal, a plate, a bar, a ceramic, and/or any other suitable rigid material or materials that exhibit or demonstrate sufficient tensile capacity (and/or other strength) to maintain the tensile force (and/or other force) transferred to it by means described herein (e.g., from rebar 4 embedded within the existing CRCP 2). Further in example, when rebar is used as the strengthening member 130, the rebar may have any suitable bar size including, without limitation, being from size #1 to size #15, including any size therein. Indeed, in some embodiments the rebar acting as the strengthening member 130 has a bar size of from #5 to #10, although other bar sizes are contemplated. In some embodiments, satisfactory tensile strength and the required pullout strength can be realized using rebar of size #6 (and/or any other suitable size) in the precast panel 110, while a rebar of size #8 (and/or any other suitable size) may be epoxy anchored (and/or otherwise coupled) in the exposed side face of the CRCP 2.

With reference to at least FIGS. 1, 4, 5, and 6, embodiments of the system 100 may further comprise one or more anchoring members 140, designed to transfer horizontal forces and vertical wheel loads from CRCP 2 to a new precast panel 110 and/or from the new precast panel 110 to the CRCP 2, which can be positioned at a depth in the exposed side face of the existing CRCP 2 and extend a distance away from the exposed side face. In this regard, the side face of the CRCP 2 can be prepped to receive one or more anchoring members by drilling, creating, boring, chiseling, punching, and/or otherwise making holes or bores 5 that extend into the side face and are that are configured in a substantially orthogonal (and/or any other suitable) orientation to the substantially vertical exposed side face. The bores 5 can be disposed in any suitable location. Indeed, in some embodiments, the bores 5 are disposed at regular intervals from one another, or configured as needed, such that the bores 5 avoid the presence of the existing continuous reinforcement 4 that was placed within the CRCP 2 at the time of its original construction. In some embodiments, the bores 5 are configured in pairs, with the two bores 5 of the pair being spaced apart by suitable distance, including, without limitation, by between about 1" and about 6" (or within in any subrange thereof). For instance, some embodiments of the bores 5 are about 4" from one another. In some such embodiments, each of the holes or bores 5 are configured to receive a portion of the anchoring member 140 with the remaining portion of the anchoring member 140 extending from the side face. For example, once the bore 5 has been prepared, the anchoring member 140 can be inserted and secured or fixedly coupled within the respective bore 5 by the use of an adhesive, sealant, fastening substance, and/or any other suitable binding material, such as glue, epoxy resin, and the like. If the adjacent panel 100 is another precast panel 110*a*, anchoring members 140 are (in some embodiments) embedded in the new precast panel 110*a* making it unnecessary to bore holes for the purpose of epoxying (or otherwise coupling) anchoring members 140.

The anchoring member 140 may be configured to have any suitable length that allows it to function herein, including, without limitation, being between about 8" and about 56" (or within any subrange thereof). Indeed, in some embodiments, the anchoring members 140 have a length of between about 18" and about 30", and in some embodiments the anchoring members 130 have a length of about 24". Each anchoring member 140 may be positioned within the CRCP 2 or an adjacent panel 110*a* such that at least a portion of the anchoring member 140 extends out of the substantially vertical side face of the CRCP 2 or adjacent panel 110*a*. For example, one end of the anchoring member 140 is (in some embodiments) configured to be embedded sufficiently into the CRCP 2 or an adjacent panel 110*a* such that the opposing distal end of the anchoring member 140 extends away from, and clear of, the side face about 5" to 9" (and/or any other suitable length between about 2" and about 18"). In some embodiments, the anchoring member 140 is configured to extend from the side face of the CRCP 2 or an adjacent panel 110*a* about 7" to 8".

Moreover, in some embodiments, the distal end of the anchoring member 140 that extends from the CRCP 2 or an adjacent panel 110*a* comprises thereon a headed portion or a head 142. The head 142 may be an enlarged portion (e.g., a circular, quadrilateral, triangular, disc-shaped, polygonal, bulbous, bent, and/or any other suitable shape) having a diameter, shape, and/or size greater than the diameter of the shaft of the anchoring member 140. The presence of the head 142 allows at least the length of some embodiments of the anchoring member 140 to be in the range of about 24", and shorter than other conventional anchors, because the head 142 develops tensile strength from/by the anchoring member 140 within the concrete of the system 100 over shorter distances.

The anchoring member 140 may be comprised of any suitable material that allows it to function as described herein. Indeed, in some embodiments, the anchoring member 140 comprises one or more pieces of rebar, deformed rebar, metal, a bar, a rod, and/or any other suitable rigid material or materials that exhibit or demonstrate sufficient tensile (and/or any other suitable type of) strength to maintain the tensile force and vertical wheel loads between the CRCP 2 and the formed panel 110 or between new precast panels 110 and 110*a*. Further in example, when rebar is used as the anchoring member 140, the rebar may have any suitable size, including, without limitation, from #1 to #15 (or within any size in that range). Indeed, in some embodiments, the anchoring member 140 has a bar size of from #5 to #11, although other bar sizes are contemplated. In some embodiments where the existing CRCP 2 is 8" to 9" thick it may be necessary to use pairs of #5 to #8 bars for each opening 150 to fit above or below rebar 4 in existing CRCP 2 within the 8" to 9" slab. Since #5 to #8 bars are much smaller than #11 bars and are typically used in thicker CRCP 2, it can be helpful to use pairs of bars to satisfactorily develop the necessary tensile and shear strength to carry the horizontal forces and vertical loads, respectively. In other embodiments, where the existing CRCP 2 is 10" to 14" thick, it can be helpful to use single #10 to #12 bars in each opening 150 to carry the same loads. In some embodiments, the single anchor 140 embodiment is attractive to use since it requires less drilling or coring to create the necessary bores 5. In any case, the anchors 140 can be epoxy anchored (and/or otherwise coupled) in the exposed side face of the CRCP 2.

Figure 10:
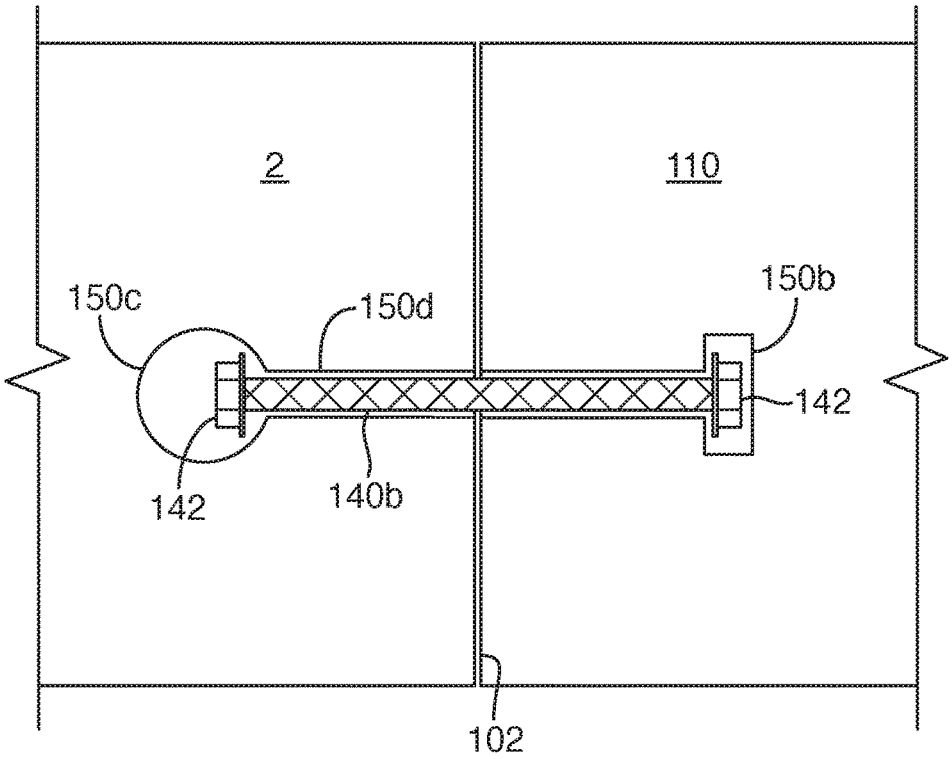
FIG. 10 depicts a partial plan view of an embodiment of a precast concrete panel repair system, in accordance with the present disclosure.

In another embodiment, one or more of the anchor members 140 optionally include one or more heads 142 on both distal ends (e.g., as shown in FIG. 10). In such an embodiment, the precast panel 100 can be cast (and/or otherwise formed) with a T-opening 150*b* and/or any other suitably shaped opening that extends from the top 101 of the panel 110 to just below the middle of the thickness of panel 110. A matching (or corresponding) modified T-opening 150*b* (and/or any other suitable opening) can be field-cut (and/or otherwise formed) in the CRCP 2 by saw cutting opening 150*d* and coring, chilling, drilling, and/or otherwise forming an abutting vertical hole opening 150*c* to the same (and/or a similar) depth s T-opening 150*b*.

In some embodiments, once the panel 110 is placed, the sawed-out inside portions of 150*d* and 150*c* are removed to make room for a double headed anchor 140*b*. In some such embodiments, openings 150*b*, 150*c*, and/or 150*d* are filled from the top (and/or any other suitable portion) of the panel 110 with a cementitious adhesive and/or any other suitable binding material to horizontally and/or vertically lock the panel 110 and the CRCP 2 together. One possible advantage of this embodiment is that epoxy bonding or other suitable binding material need not be used to anchor the double headed anchors 140*b* in position.

In yet another embodiment, one or more pairs of double-headed anchors 140*b* are installed in the CRCP 2 as indicated above in the same configuration to that shown in FIG. 4. In some such embodiments, fastening members 120 and/or segments 124 can be made to reside between the pair of double headed anchors 140*b*.

Figure 11A:
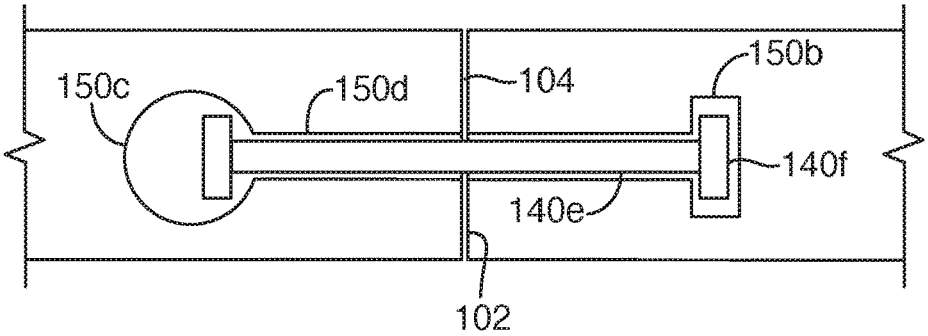
FIG. 11A depicts a partial plan view of an embodiment of a precast concrete panel repair system, in accordance with the present disclosure.
Figure 11B:
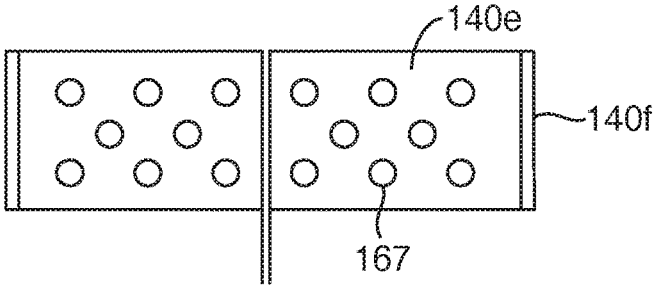
FIG. 11B depicts an elevation view of an embodiment of a precast concrete panel repair system, in accordance with the present disclosure.

Referring to FIGS. 11A-11B, yet another embodiment involves an anchor member 140*e* comprising, a perforated, non-perforated, knurled, processed, recessed, bent, zig-zag, and/or any other suitable type of plate and/or other suitable object comprising stainless steel, steel, fiberglass, metal, metal alloy, a ceramic, and/or any other suitable material to which may be welded, bonded, bolted, bent, and/or otherwise coupled to a narrow stainless steel, steel, fiberglass, metal, metal alloy, ceramic, and/or any other suitable plate (or object) at right angles (and/or any other suitable angles) to the plate (or other object) to form a flange to approximate an enlarged head analogous to head 142 attached to headed anchor 140. Another embodiment, not shown, of providing a perpendicular flange or an approximation of an enlarged head may be provided by bending approximately 1" (or any other suitable portion) of both distal ends of the plate (or other object) to provide a half flange.

The anchor member 140*e* may configured to any suitable height that allows it to function as intended. Indeed, in some embodiments, the anchor member 140*e* has a height of approximately one half the thickness of the precast panel 110. In such an embodiment, the precast panel 110 can be cast with a T-opening 150*b* (and/or any other suitable shaped opening) that extends from the top surface 101 of the panel 110 to just below the middle of the thickness (or any other suitable portion) of the panel 110. Once the panel 110 is placed, the sawed or bored-out inside portions of 150*d* and 150*c* can be removed to make room for a double headed anchor plate 140*e*. In some such embodiments, openings 150*b*, 150*c*, and/or 150*d* are filled from the top (and/or any other suitable portion) of the panel 110 with a cementitious adhesive and any other suitable binding material, but in some embodiments, not an epoxy anchoring material, to horizontally and vertically lock the panel 110 and the CRCP 2 together to carry horizontal and vertical forces from the panel 110 to the CRCP 2 and/or from the CRCP 2 to the panel 110. In this regard, the holes 167 can provide an avenue or means for the cementitious adhesive, grout, concrete filler, and/or other binding material to penetrate the double-headed anchor plate (e.g., as shown in FIG. 11B) to provide the necessary resistance against tensile and vertical forces acting between the precast panel 110 and/or the CRCP 2.

With further reference to at least FIGS. 4 and 5, some embodiments of the system 100 comprise the fastening member 120 being comprised of more than one element, section, portion, or piece. For example, the portion of the fastening member 120 that is embedded in the panel 110 and the segment 124 can comprise one piece. In some other embodiments, however, the portion of the fastening member 120 that is embedded in the panel 110 can comprise one piece, while the segment 124 that extends into the opening 150 may be another piece. In some such embodiments, this simplifies forming to create opening 150. The fastening member 120 embedded into the panel 110 can comprise a receptacle 126 configured to receive at least a portion of the segment 124 to couple the segment 124 to the fastening member 120, such that the segment 124, the receptacle 126, and the portion of the fastening member 120 within the panel 110 function to provide rigidity and tensile strength to the panel 110 as if one singular piece. In some embodiments, the receptacle 126 defines an internal cavity that is not only open to the opening 150 but is also internally threaded. Cooperatively, one end of the segment 124 can be externally threaded to match the thread patterns of the internal cavity of the receptacle 126. As such, the segment 124 may be inserted into the opening 150 and threaded into the receptacle 126 to thereby be coupled to the fastening member 120. Nevertheless, the segment 124 and the fastening member can be coupled together in any other suitable manner, including, without limitation, via one or more other treaded engagements, mechanical coupling mechanisms, frictional coupling mechanisms, and/or in any other suitable manner. Moreover, some embodiments of the segment 124 also comprise one or more heads 122 on the distal end of the segment 124 so as to be positioned within the opening 150, as described herein.

Figure 18A:
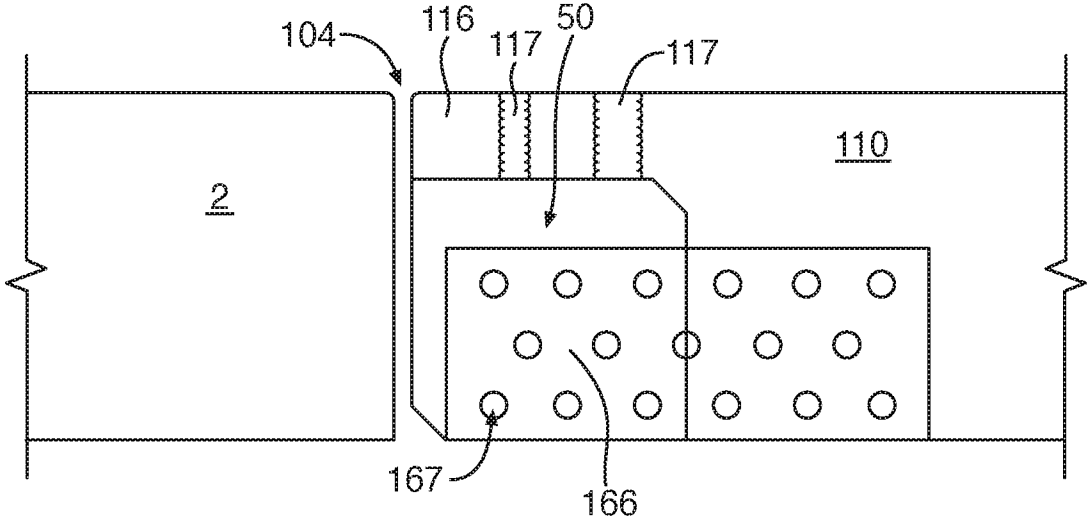
FIG. 18A depicts a partial cross-sectional view of an embodiment of a precast concrete panel repair system, in accordance with the present disclosure.
Figure 18B:
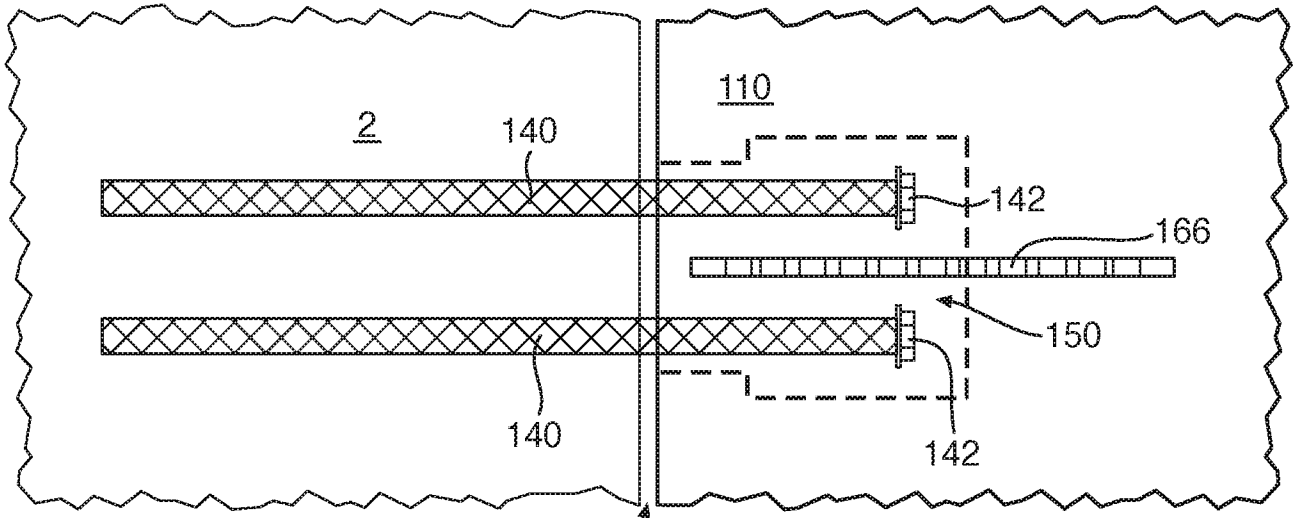
FIG. 18B depicts a partial see-through plan view of an embodiment of a precast concrete panel repair system, in accordance with the present disclosure.

Embodiments of the system 100 may further comprise a one or more perforated, recessed, protuberated, and/or otherwise shaped plates and/or other objects that are configured to carry tensile forces and vertical loads from grout filled opening 150 to panel 110. By way of non-limiting illustration, FIGS. 18A and 18B show some embodiments, in which the panel 110 comprises one or more perforated plates 166 to carry tensile forces and vertical loads from grout filled opening 150 to panel 110. In some such embodiments, the plate 166 comprises, for example, a fiberglass material having perforations, bores, recesses, and/or holes 167 therein, there through, or a combination of both. In addition to fiberglass, it is contemplated that the plate 166 can comprise any other suitable materials, such as metals, plastics, composites, glasses, ceramics, rods, and/or any other suitable materials that allow the plate to function as described herein.

Moreover, some embodiments of the system 100 optionally comprise the plate 166 being at least partially embedded in the precast panel 110 with another remaining portion thereof extending into the opening 150 (e.g., as depicted in FIGS. 18A and 18B). Also, once the panel 110 is placed in position near the CRCP 2 or adjacent precast panel 110*a*, some embodiments of the system 100 comprise the plate 166 being configured to extend between or next to one or more (e.g., a pair) of the anchoring members 140. Then, with the panel 110 in place, the cementitious adhesive and/or other binder, such as grout, may be inserted within the opening 150. In some such embodiments, the holes 167 provide an avenue or means for the cementitious adhesive, grout, concrete filler, and/or any other suitable binder to penetrate to provide the necessary resistance against tensile forces (and/or other forces) between the binder filled opening 150 and the precast panel 110. Sufficient strength to accomplish this may be derived from plates 166 in the order of ½" (or less) thick making it possible to reduce the width of openings 150, though any other suitable width plates can be used.

As mentioned, some embodiments of the system 100 further comprise one or more optional recesses 154 configured in one or more of the vertical side walls of the opening 150. For example, the recesses 154 may be slots, notches, grooves, dents, depressions, concavities, and/or any other impressed forms and shapes that extend further into the intermediate concrete section 160 than does another portion (e.g., the rest) of the opening 150. The recess 154 may be positioned in one or more side wall surfaces of the opening 150, the side wall being oriented in a substantially orthogonal (and/or any other suitable) manner to a back wall surface from which the fastening member 120 protrudes. The recess 154 may extend in a vertical manner up the entire vertical sidewall from the bottom surface 103 of the panel 110 to the top of the cavity 150. Other embodiments may comprise the recess 154 extending for only a portion of the vertical sidewall (e.g., as seen in FIGS. 17A and 17B). In accordance with some embodiments, the recess 154 has a width of between about ¼ and about ½ (and/or any other suitable portion) of the depth of the opening 150. The recess 154 can be positioned in any suitable location. Indeed, in some embodiments, the recess 154 is substantially centered in the sidewall, meaning the distance from the center of the recess 154 from the face 102 or 106 is substantially the same as the distance from the center of the recess 154 to the back wall of the opening 150. As such, when the recess 154 is filled with concrete, grout, other cementitious product, and/or any other suitable binder to couple the panel 110 to the CRCP 2 or to an adjacent precast panel 110*a*, the concrete, grout, other cementitious product, and/or other suitable binder hardens within the recess 154 and the recess 154 functions as a grip, clasp, clutch, fastener, and/or hold to maintain or keep the concrete, grout, other cementitious product, and/or binder from being pulled out of the opening 150 under force. In other words, the recess 154 is designed and configured, in accordance with some embodiments, as a type of mechanical or structural lock to interact with the concrete, grout, other cementitious product, and/or other binder to prevent the materials within the opening 150 from sliding horizontally out of the opening 150 once hardened.

Some embodiments of the system 100 further comprise the recess 154 having one or more hard, sharp, or abrupt edges, including, without limitation, a substantially orthogonal corner 155, as shown in FIG. 4. Use of the sharp corners 155 may increase the effectiveness of the recess 154 in preventing slippage. Moreover, in some embodiments, one or more openings 150 are configured with opposing recesses 154, in that one recess 154 is defined or positioned in a sidewall of the opening 150, as explained, and another recess 154 is defined or positioned in the opposing sidewall of the same opening 150, such that the opening 150 has at least two recesses 154 that oppose one another on opposite sidewalls, as depicted at least in FIG. 4. In some cases, more than one recess 154 within one opening 150 can also increase the effectiveness of the recess 154 in preventing horizontal slippage of hardened material or binder out of the opening 150.

With further reference to at least FIGS. 4-7, some embodiments of the system 100 comprise methods of the panel 110 being set into place in the existing CRCP 2. In this regard, it is noted that all methods and the various portions thereof can have portions be: reordered, omitted, substituted, repeated, replaced, performed simultaneously, performed in series, and/or otherwise be modified in any suitable manner. In some embodiments, however, portions of the existing CRCP 2 that need repair may be removed. In this regard, such portions can be removed in any suitable manner, including, without limitation, by being removed by jackhammer, backhoe, excavator, and/or in any other suitable manner. In some embodiments, however, the portion of the CRCP 2 that needs to be removed is cut out by making full-depth (and/or any other suitable type of) cuts in the CRCP 2 and then removing the CRCP 2 that has been cut out.

In accordance with some embodiments, the empty space may thereafter be configured to receive thereon a layer of fine aggregate bedding material or cement treated base material AA (e.g., as shown in FIG. 6) which is then precisely graded to accurately support the panel 110 in position. Alternatively, the subgrade may be over-excavated to make room for a rapid setting concrete base AB which is then precisely finished to accurately support the panel 110 in position. To further refine vertical positioning of the panels 110 and 110*a*, both may contain embedded therein one or more leveling devices AC (e.g., comprising any suitable leveling device and/or devices) that can be used temporarily to raise the panels to best fit the adjacent CRCP 2 and/or the precast panel 110. Any void resulting from this process between the panels 110 and 110*a* can be filled with bedding grout injected under the panels (e.g., as shown in FIG. 6) and/or in any other suitable manner.

Moreover, prior to the panel 110 being set in position, the exposed side walls of the CRCP 2 may be prepared to receive therein the anchoring members 140, as disclosed herein. In some embodiments, the bores 5 into which the anchoring members 140 will be inserted and epoxy anchored are set in pairs, so that the pair of anchoring members 140 can be about 4" (or any other suitable distance) apart from one another so that the pair of anchoring members 140 can fit within the opening 150 of the panel 110 when the panel 110 is set in place. Also, some embodiments of the system 100 are configured to have one of the fastening members 120 be positioned in between the pair of anchoring members 140 (e.g., as depicted in FIG. 4), when the panel 110 is set in place, such that the fastening member 120 resides between the anchoring members 140 within the opening 150.

Embodiments of the system 100 may further comprise a portion of the length of the fastening member 120 and/or segment 124 overlapping and/or extending beyond a portion of the length of the anchoring member 140 within the opening 150 (e.g., as depicted in at least FIGS. 4 and 5. For example, to position the panel 110 next to the CRCP 2 and/or the panel 110 next to another panel 110*a*, the opening 150 is positioned over the pair of anchoring members 140 such that the fastening member 120 and/or segment 124 resides there between. Also, the head 122 of the fastening member 120/or segment 124 extends into the opening 150 beyond respective heads 142 of the pair of anchoring members 140 that extend in the opposite direction into the opening 150. In some embodiments, with the panel 110 or 110*a* set in position, the head 122 resides proximate and/or substantially near the joint 104 between the panel 110 and the CRCP 2 and/or between the panels 110 and 110*a*, whereas the heads 142 reside proximate or substantially near the back face of the opening 150, all under the respective concrete portion 116 of the respective opening 150, as depicted in FIGS. 4, 5, 17A, and 17B. Some embodiments of the system 100 further comprise the head 122 of the fastening member 120 and/or segment 124 extending into the opening 150 beyond the recess 154. In like manner, some embodiments of the system 100 further comprise the heads 142 of the anchoring members 140 extending into the opening 150 beyond the other side of the recess 154 from where the head 122 is positioned.

Some embodiments of the system 100 further comprise the panel 110 or 110*a* being configured to support and/or handle vehicular and automotive traffic with the panel 110 or 110*a* merely set in position and not cemented (or otherwise bound) into position. In other words, once the panel 110 is set in place next to the CRCP 2 or next to a second precast panel 110*a* (e.g., as shown in FIG. 6), the panel 110 is ready to have traffic travel thereupon by virtue of the precision grading or finishing already described herein. The panel 110 may be permanently fixed in position (e.g., once it has been vertically adjusted to a best fit by virtue of one or more leveling devices AC) using an adhesive, such as concrete, dowel grout, and/or any other suitable binder, being inserted, injected, and/or otherwise placed within the openings 150 of the system 100 and in the joint 104 and by using bedding grout AD injected, pumped, and/or otherwise placed below the precast panels 110 and 110*a*. In some embodiments, the adhesive or binder used to fix or otherwise connect the panel 110 with the CRCP 2 or adjacent precast panel 110*a* comprises a dowel grout that is a fast-setting, high-strength, cementitious grout, that is less costly and less time-consuming than UHPC rapid-setting splice concrete that is used in recently-developed conventional repair systems. In fact, in some embodiments of the system 100, no cast in place (CIP) concrete of any kind is required to fix the panel 110 in position with the CRCP 2 (at least not within one or more of the openings 150).

Once the cementitious adhesive and/or other binder is placed within the openings 150, the cementitious adhesive begins to dry and harden. Once it is hard, it is capable of resisting compressive loads placed upon it by heads 122 and 142 that are attached to anchoring members 140 and/or the fastening members 120. As the precast panel 110 or 110*a* cures and cools due to decreasing ambient temperatures, shortening stresses are ultimately transferred from the anchoring members 140 and the fastening members 120 (e.g., 124) to heads 122 and 142, both acting in opposite directions placing the cementitious adhesive and/or other binder between the heads in compression.

Figure 7:
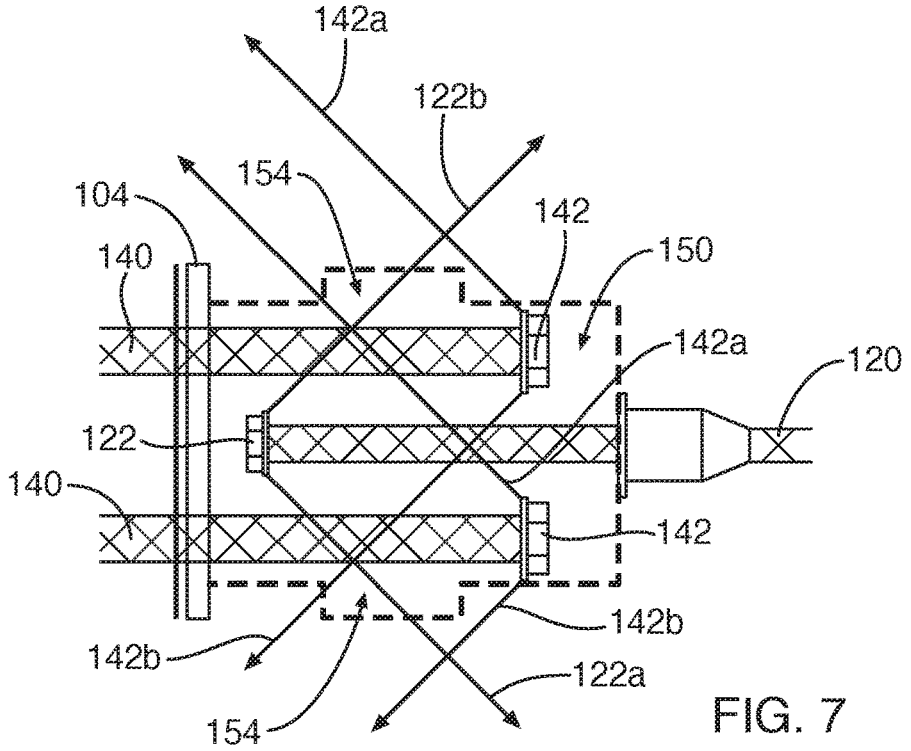
FIG. 7 depicts a see-through, partial plan view of the embodiment of the precast concrete panel repair system of FIG. 1, in accordance with the present disclosure.

The compressive forces exerted by the head 122 on the cementitious adhesive within the opening 150 can extend from the head 122 in the direction of the shaft of the fastening member 120, but in an outwardly expanding conical shape and not a straight line. Such force can be described as a shear cone in the industry. As depicted in FIG. 7, the head 122 creates the shear cone force depicted by the arrows 122*a* and 122*b*, which radiate outward at about 45 degree angles in a 360 degree pattern all around the circumference of the head 122 Likewise, the compressive force exerted by the head 142 on the cementitious adhesive within the opening 150 can extend from the head 142 in the direction of the shaft of the anchoring member 140, but in an outwardly expanding conical shape and not a straight line. Such force can be described as a shear cone in the industry. As depicted, the head 142 creates the shear cone force depicted by the arrows 142*a* and 142*b*, which radiate outward at about 45 degree angles in a 360 degree pattern all around the circumference of the head 122.

Embodiments of the system 100 comprise the shear cone force of the head 122 configured to not only intersect, overlap, cross, and/or otherwise traverse the shear cone force of at least one of the heads 142, if not both of the heads 142, within the opening 150, but also configured to oppose the shear cone force of the heads 142. Furthermore, the shear cone force created by the heads 122 and 142 may extend into the intermediate concrete sections 160, such that the shear cone force of the head 122 not only intersects, overlaps, crosses, and/or otherwise traverses the shear cone force of at least one of the heads 142, if not both of the heads 142, within one or more of the intermediate concrete sections 160, but also opposes the shear cone force of the heads 142. At least one of the benefits of having overlapping and opposing shear cone forces created by the respective heads 122 and 142 in the opening 150 and the intermediate concrete section 160 is that, in some embodiments, the tensile forces in the panel 110 and in the existing CRCP 2 are transferred through the joint 104 between the CRCP 2 and the panel 110 and between panel 110 and any adjacent panel 110*a*. An additional benefit of the system 100 according to some embodiments is that the position of the recess 154 within the opening 150 ensures positive cementitious adhesive (or binder) and concrete panel 100 engagement under tensile load. An additional benefit of the system 100, described above, is the ability of some embodiments to introduce tension across the joint 104 between the panel 110 and the CRCP 2, as described heretofore. The desire to maintain tensile capacity across the joint 104 may be necessary in certain conditions to maintain tensile forces that remain or will increase in adjacent stretches of CRCP 2. An additional benefit of the system 100 is that some embodiments that include the dove-tail shape of the opening 150 in concert with the concrete portion 116 over opening 150 effectively encapsulate or contain the cementitious material (or binder) around headed anchor 142 such that vertical loads imposed upon either panel 110 or the CRCP 2 can be effectively transferred across the joint 104 as required by good pavement design.

Figure 9:
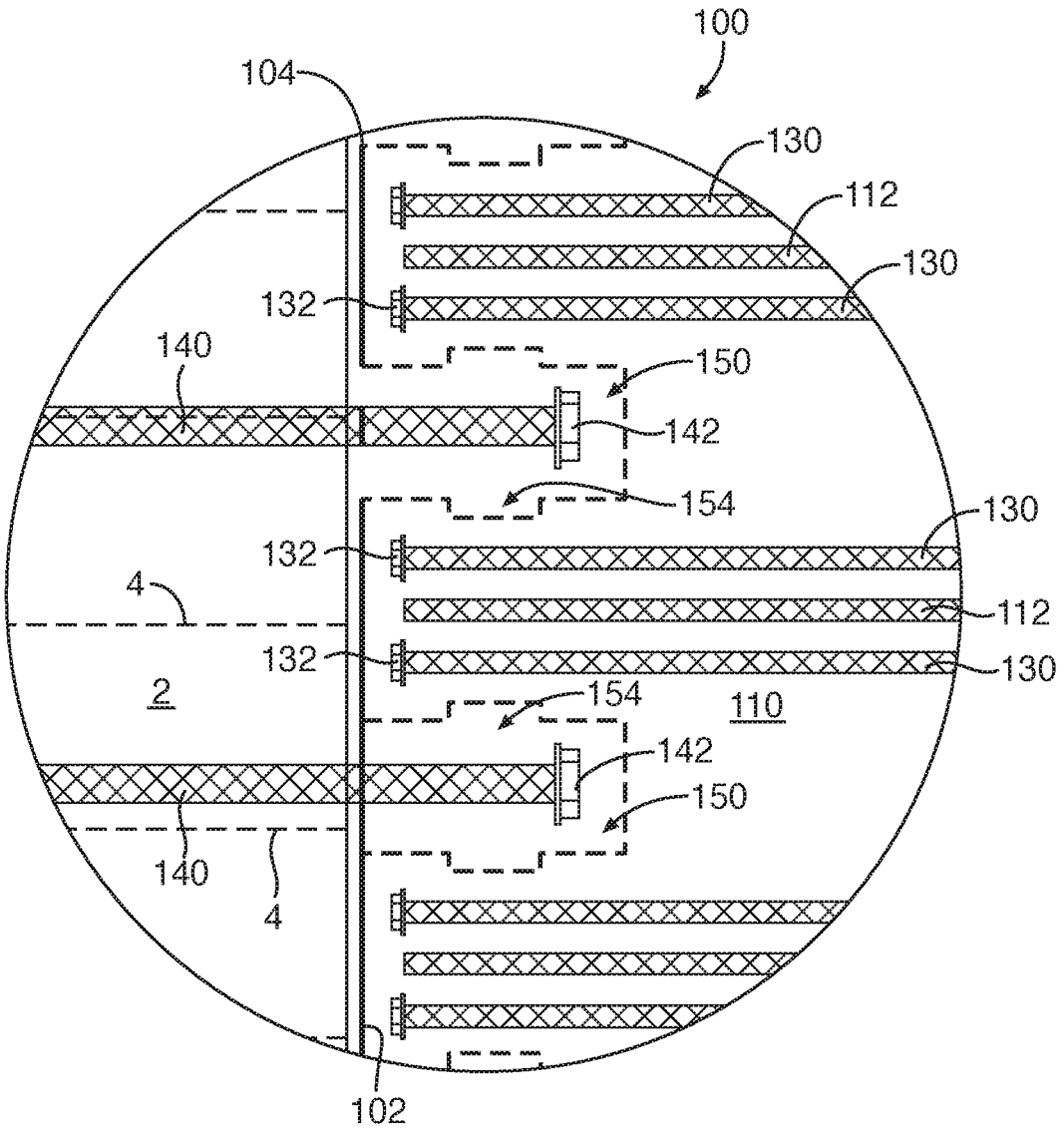
FIG. 9 depicts a see-through, partial plan view of an embodiment of a precast concrete panel repair system, in accordance with the present disclosure.

With reference now to FIG. 9, some embodiments of the system 100 comprise a singular anchoring member 140 extending from the side face of the CRCP 2 and being configured to be positioned within a relatively narrow opening 150 when the panel 110 is set in place. Such an embodiment can be useful where the existing CRCP 2 is thicker, perhaps between 9" and 14" (or any other suitable thickness) thereby allowing the use of one bigger anchoring member 140 rather than two or more smaller members as described previously for thinner pavements. In such embodiments, the size of the anchoring member 140 may be any suitable size rebar and/or other suitable object, including, without limitation, rebar having a size between #8 and #14

(or any rebar size therein). Indeed, in some such embodiments, the anchoring member 140 comprises a size #11 rebar. In this regard, the larger circumference of a #11 bar can (in some embodiments) provide enough bonding surface between the rebar anchoring member 140 and the surrounding CRCP 2 to adequately develop the required tensile capacity. Also, in such embodiments, it may not be necessary to include a fastening member 120 or fastening member segment 124 within the panel 110 to extend into one or more (e.g., any) of the openings 150 of the panel 110. Instead, the size of the anchoring member 140 within the opening 150 and the head 142 thereon can be enough to create a shear cone force against at least the recesses 154 positioned in the opening 150, such that the singular anchoring member 140 can maintain the tensile (and other) forces between the panel 110 and the CRCP 2 and/or between adjacent precast panels 110 and 110*a*. In such embodiments, the opening 150 can be any suitable width, including, without limitation, between about 1" and about 8" wide (or within any subrange thereof). Indeed, in some cases, the opening is only need to be about 3"±1" wide to accommodate the placement of the singular anchoring member 140. Thus, the strength and structural integrity of the panel 110 may be increased around openings 150 with the use of the smaller opening 150 and the singular anchoring member 140 situated closer to adjacent opposing anchoring members 130 and heads 132 encased within the intermediate concrete section 160 increasing the capacity of the intersecting shear cones. Some embodiments of the system 100 having a singular anchoring member 140 without the corresponding fastening member 120 or 124 can be useful also in conditions where the tensile capacity needed across the joint 104 is decreased, such as when temperature swings between winter and summer are smaller.

Figure 12:
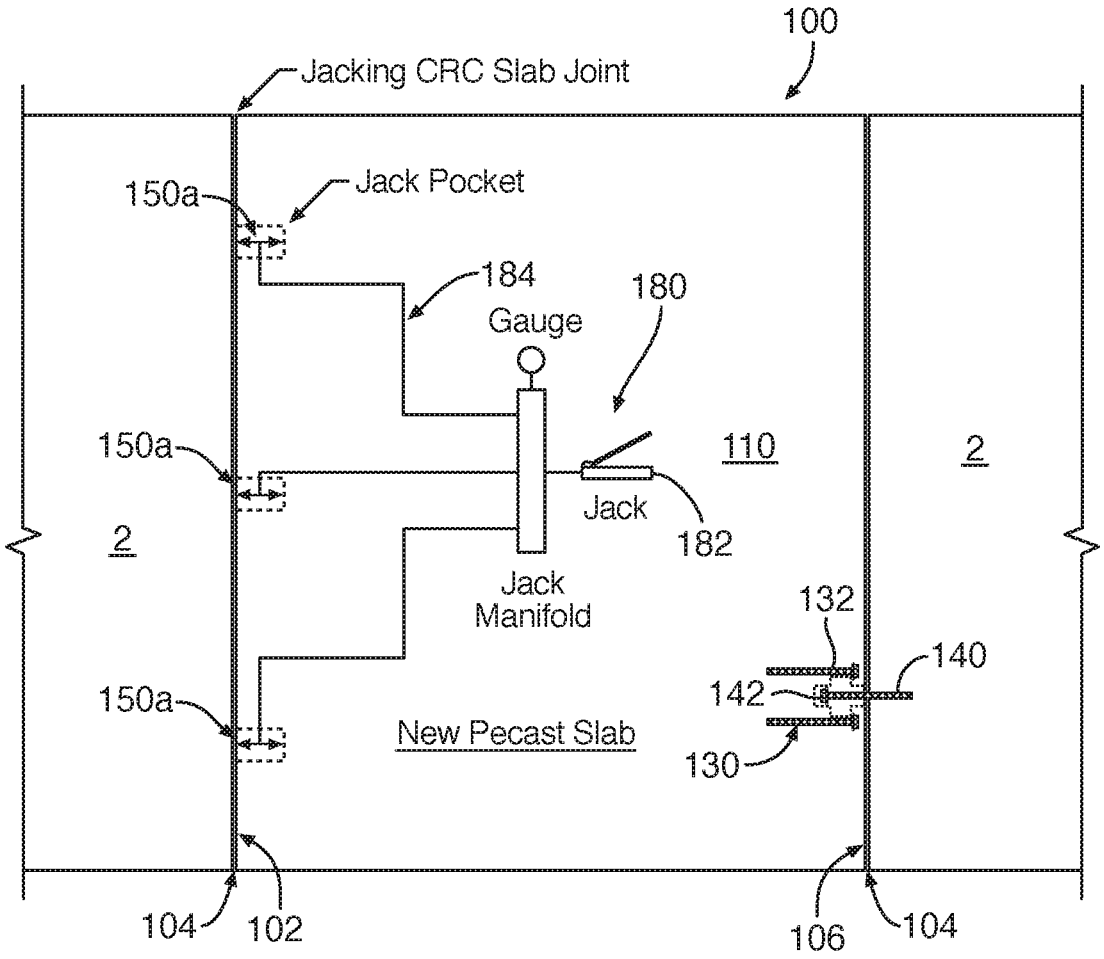
FIG. 12 depicts a plan view of a component part of an embodiment of a precast concrete panel repair system, in accordance with the present disclosure.
Figure 13:
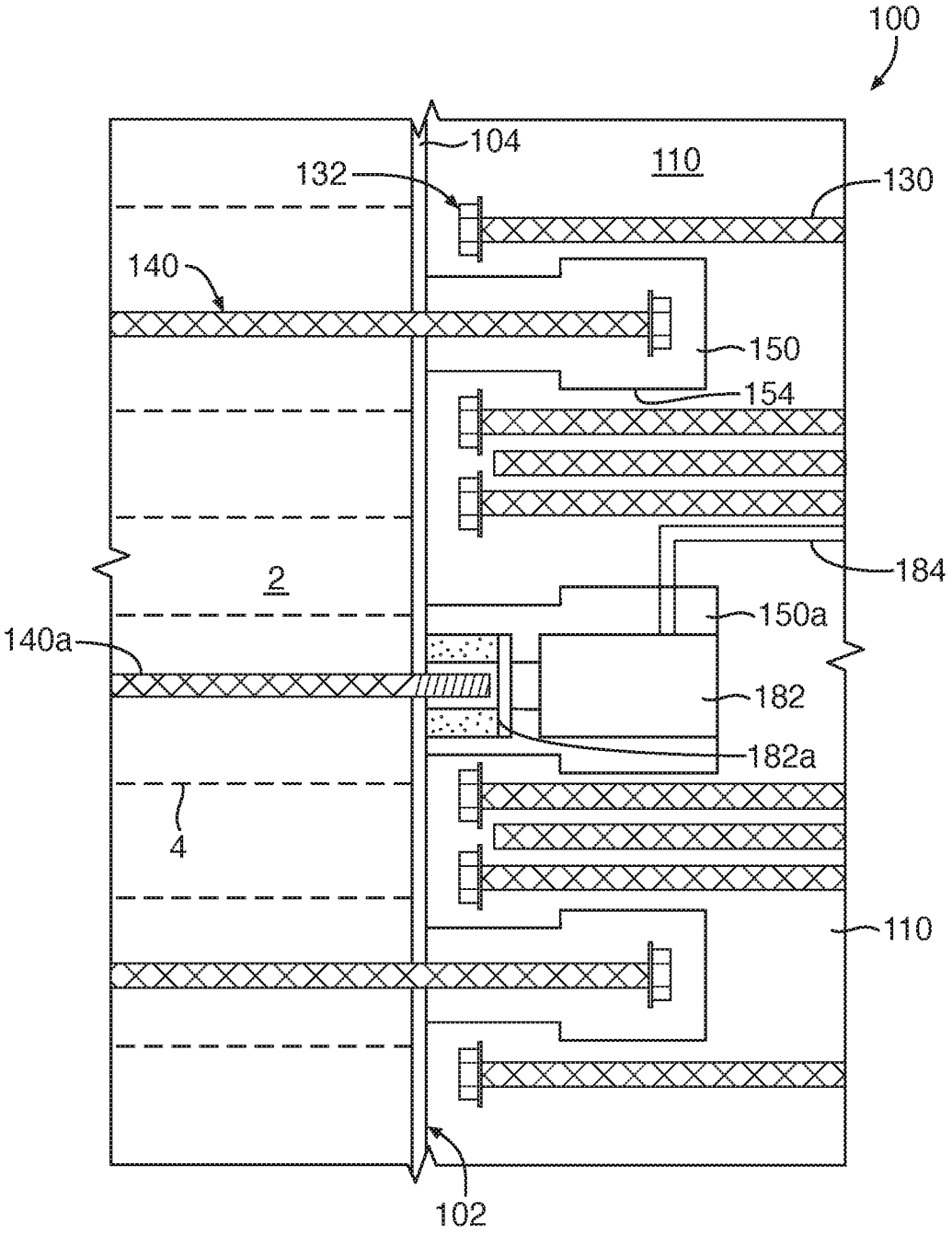
FIG. 13 depicts a close-up view of component parts of the embodiment of a precast concrete panel repair system of FIG. 12, in accordance with the present disclosure.
Figure 14:
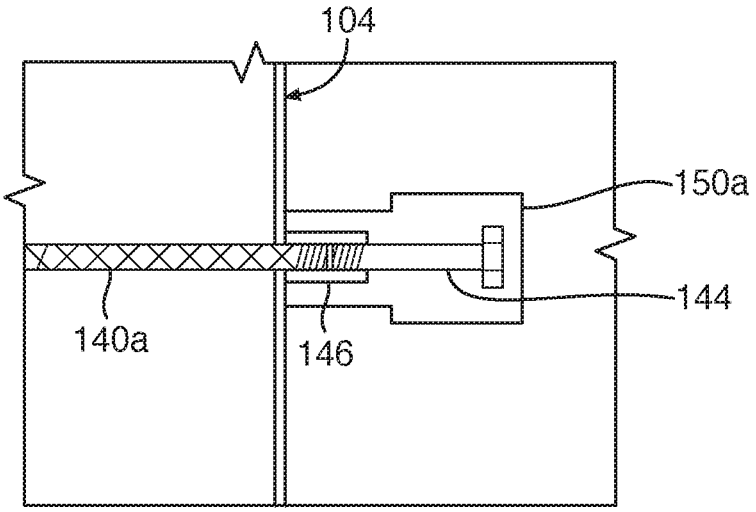
FIG. 14 depicts a close-up view of component parts of the embodiment of a precast concrete panel repair system of FIG. 13, in accordance with the present disclosure.

With reference now to FIGS. 12, 13, and 14, some embodiments of the system 100 comprise using one or more compression-inducing devices 180 and/or 182, such as a series of interconnected hydraulic jacks or the like. In this regard, some of the embodiments previously described herein are directed to installation of new precast repair panels 110 and/or 110*a* that are designed to preserve or restore tensile capacity across a newly-installed panel or a series of new panels. A compression inducing mechanism may be necessary when it may desired to reintroduce compression at the time of repair in adjacent CRCP 2 that may have been subjected to a relaxation of an existing compressive force because of a removal of a section of the CRCP 2 for repair. Relaxation, in this case, may be exhibited when adjacent CRCP 2 moves into the hole or space created by removal of a section of it for repair. Such a need for a compression inducing device may arise when, for example a repair is made in the middle of the summer in a section of CRCP 2 that was originally installed in cooler months. Some compression in the adjacent relaxed CRCP 2 may be reintroduced by using precast panels 100 that are fabricated to accommodate one or more compression-inducing devices 180 that may further comprise individual jacks 182 that may be positioned in jack pockets 150*a*, which are simply openings 150 that have been configured to open up to the top surface 101 of the panel 110. The individual jacks 182 can therefore be positioned in the respective jack pockets 150*a* and coupled to the compression-inducing device 180 by any suitable respective couplers 184, such as a hydraulic line.

In accordance with some embodiments, restoration of compression is accomplished in a two-step process. In the first step, one or more jacks 182 are (in some embodiments) inserted in three, four, or any other suitable number of openings 150*a* that are the same as openings 150 except they are open to the top surface 101 of the panel 110. With the compression-inducing device 180 ready, or before the device 180 is used, at least one other joint 104 can be grouted or fixed in place with the cementitious adhesive (or other binder) being placed into the openings 150 and respective joints 104. Then, once grout in adjacent joints is hardened, the compression-inducing device 180 can be configured and activated to cause the jacks 182 to press against the CRCP 2 and the jack pocket 150*a* to thereby introduce compression in the panel 110 and the CRCP, in an operation that tends to increase the width of the joint 104 or, in other words, to push adjacent sections of the CRCP 2 and the panel 110 apart. With the panel 110 in a compressed state, the cementitious adhesive (or other binder) can be placed into the openings 150 along the side where the compression-inducing device 180 is acting and in joint 104. In the second step of the process, once the cementitious adhesive is hardened, the compression-inducing device 180 is in some embodiments released so the jacks 183 may be removed. At that point, the panel 110 will remain in the compressed state. Once the jacks are removed headed segment 144 is attached to threaded anchor 140*a* by virtue of a threaded bolt coupling 146 and/or in any other suitable manner. Jack openings 150*a* are then filled with cementitious adhesive (and/or any other suitable material) to complete the newly compression connection for opening to traffic. Once this is completed the headed anchor 144 and/or adjacent headed anchors 140 are configured to resist tensile forces during cooler months.

Figure 15:
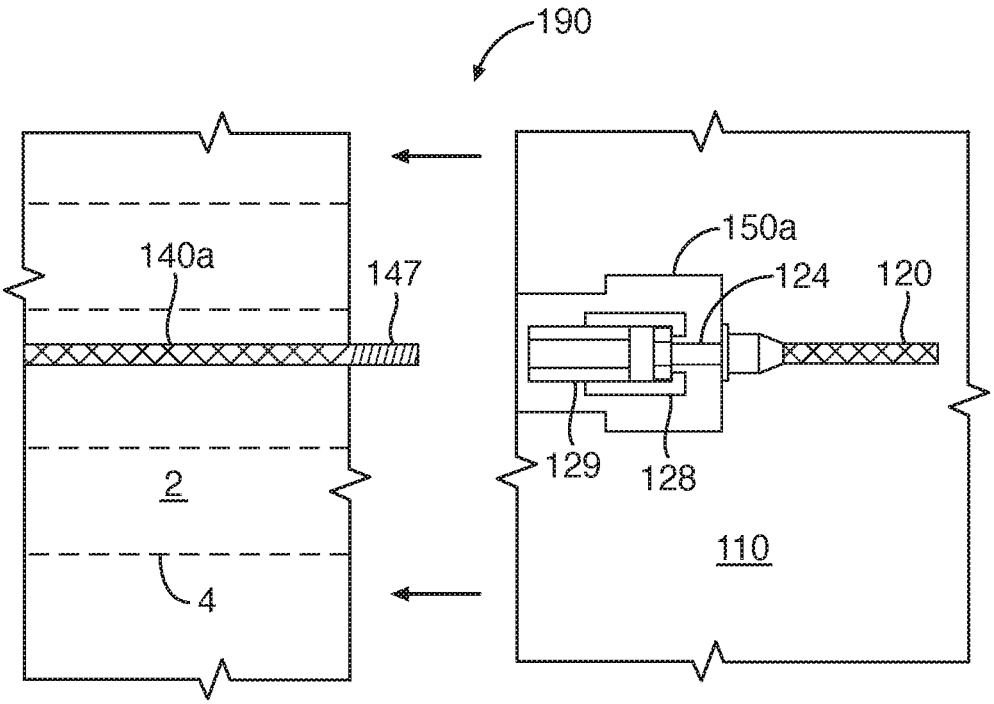
FIG. 15 depicts a plan view of a component part of an embodiment of a precast concrete panel repair system, in accordance with the present disclosure.

With reference to FIG. 15, some embodiments of the system 100 comprise one or more tension-inducing devices 190. A tension inducing device may be necessary when it may desired to restore the tension that may have existed in adjacent CRCP 2 prior to removal of a section for repair. Such relaxation of tensile stress may occur when, for example, a repair is made in cooler winter months, when the panels have contracted the most, in a CRCP 2 that was originally installed in warm summer months. Relaxation in this case may be exhibited by adjacent sections of CRCP 2 moving apart when a section of it is removed for repair. In some embodiments of the system 100, it may be useful to introduce and/or otherwise create tensile force in the panel 110 and across one or more of the joints 104 with the CRCP 2 to substantially restore the existing tensile forces in the CRCP 2 before the section was removed for repair. In accordance with some embodiments, the tension-inducing device 190 may further comprise an anchoring member 140*a* embedded in the CRCP 2, the anchoring member 140*a* having a threaded distal end 147. The tension-inducing device 190 may further comprise a modified opening 150*a* that is similar to other openings 150 except that it extends to the top 101 of the panel 110 configured to house coupling components 129 and 128. Within the opening 150*a*, a headed fastening member 124 is (in some embodiments) configured to extend therein. On the distal end of the fastening member 124 within the opening 150*a*, a coupling 129 is (in some embodiments) fastened or coupled. In some embodiments, the coupling 129 is configured to cooperate with or mate with the threaded distal end 147 and female coupling 128 (and/or to couple in any other suitable manner). Once the panel 110 is set in place and one of the adjacent joints 104 is grouted or fixed in place with the cementitious adhesive being placed into the openings 150, the coupling 129 together with coupling 128 can be brought in contact with the threaded distal end 147 such that the coupling 129 engages the end 147. By operation of the coupling 129, such as by turning or spinning, some embodiments of the coupling 129 exert tensile force on the end 147 to thus pull the coupling or the end 147 closer together to panel 110 thereby creating a tensile force within the panel 110 and the rebar 4 in the CRCP 2. With the panel 110 and the CRCP 2 in a tensile-induced state, the cementitious adhesive can be placed into the openings 150*a* and in the corresponding joint 104 along the side and joint 104 where the device 190 is acting. The device 190 is (in some embodiments) left in place leaving the panel 110 and the CRCP 2 in a state of the desired tension.

Figure 16:
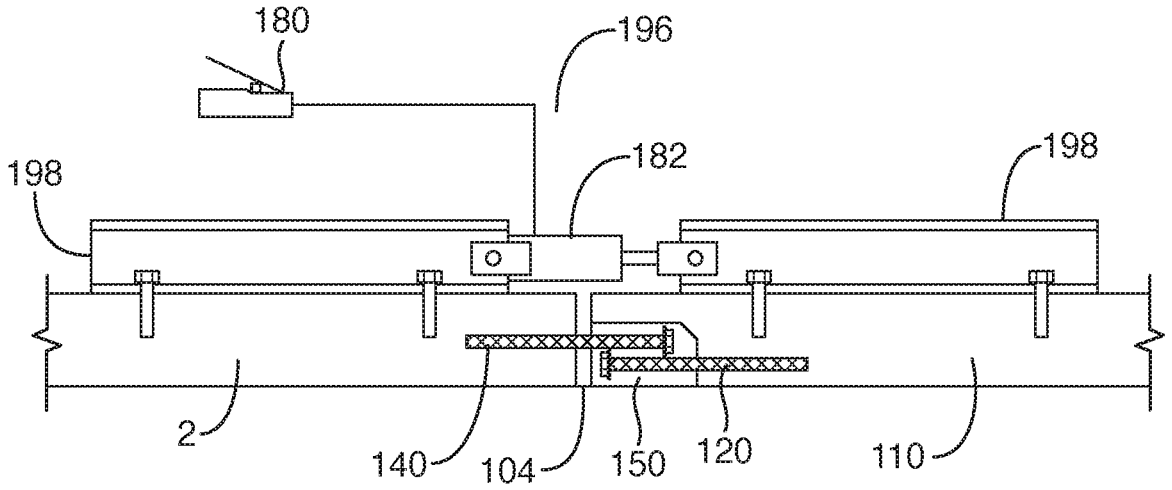
FIG. 16 depicts a cross-sectional view of a component part of an embodiment of a precast concrete panel repair system, in accordance with the present disclosure.

With reference to FIG. 16, some embodiments of the system 100 optionally comprise an additional embodiment of one or more tension-inducing devices 196. In this regard, some embodiments of the device 196 further comprise one or more beams 198 releasably coupled to the panel 110 and the CRCP 2. In one example, one beam 198 is coupled to the panel 110 and another beam 198 is coupled to the CRCP 2. In some embodiments, the device 196 further comprises a tension inducing jack 182, which may be configured between the two opposing beams 198. Additionally, in some embodiments, the jack 182 comprises a hydraulic jack and can be operated to exert force on the two beams 198 to pull the two beams closer together and thereby pull the panel 110 closer to the CRCP 2 in/over the joint 104. Of course, in accordance with some embodiments, the opposing joint 104, or the joint 104 on the opposite side of the panel 110 may have been grouted or fixed in place with the cementitious adhesive being placed into the respective openings 150. Then, with the panel in a tensile induced state, the cementitious adhesive can be placed into the openings 150 that houses opposing headed anchoring members 140 and headed fastening member 120 along the side where the device 196 is acting. Thereafter, once the cementitious adhesive is dry, the device 196 may be released and removed and the panel 110 will remain in a state of tension as desired.

In addition to the aforementioned features, the described systems and methods can be modified in any suitable manner. For instance, while some embodiments of the described panel 110 have one or more openings 150 (and/or any other corresponding components) at one end (e.g., the first face 102), in some other embodiments, the panel 110 has one or more openings 150 (and/or other components) at two opposing ends (e.g., the first 102 and second 106 faces). In still other embodiments, the panel 110 comprises one or more openings 150 and/or other components) at one, two, three, four, and/or any other suitable number of sides. In this regard, while the Figures generally show that the panel 110 is rectangular or square, the panel can be any other suitable shape, including, without limitation, being hexagonal, trapezoidal, octagonal, pentagonal, polygonal, symmetrical, asymmetrical, regular, irregular, and/or any other suitable shape.

In still another example of a suitable modification, in some embodiments, in place of or in addition to comprising one or more recesses 154, one or more of the internal side walls of the openings 150 are otherwise non-linear (e.g. comprise one or more catches, protuberances, fins, splines, run at a non-perpendicular angle with respect to the first 102 and/or second 106 faces, and/or are otherwise shaped so as to not be completely linear and so as to thereby capture the hardened binder within the opening 150).

Figure 5B:
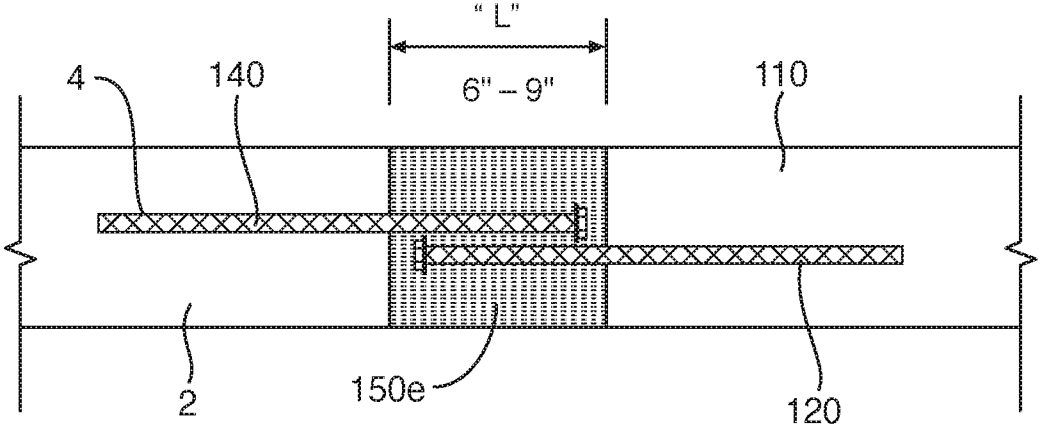
FIG. 5B depicts a cross-sectional, partial side view of an embodiment of the precast concrete panel repair system, in accordance with the present disclosure.

In still another example of a suitable modification, FIG. 5B shows an embodiment in which the system 100 comprises one or more panels 110 and/or 110*a* that are fabricated to have one or more faces (e.g., side faces 102 and/or 106) with no openings 150 extending into the panel 110 and/or 110*a* (and/or at least with no openings having a fastening member 120 extending therefrom) such that those faces of the panel 110 are solid, plain, planar, flat, orthogonal to the top surface 101, and/or have any other suitable characteristic. In some such embodiments, the CRCP 2 is cut with a full-depth cut (and/or any other suitable cut). In some such embodiments, the panel 110 is sized and placed such that there is a full-depth space 150*e* between a side face (e.g., side face 102) of the panel 110 and a cut face of the existing CRCP 2.

Additionally, in some such embodiments, one or more fastening members 120 extend beyond one or more side faces 102 and/or 106 of the panel 110, such that the fastening members' corresponding heads 122 and/or ends reside near the cut face (e.g., a full-depth and/or any other suitably cut face) of the CRCP 2 when the panel 110 is placed near the CRCP 2. In some such embodiments, one or more anchoring members 140 are anchored to the CRCP 2 and positioned to miss one or more of the fastening members 120 when the anchoring members 140 extend into a full-depth opening 150*e* between the CRCP 2 and the panel 110 such that the heads 142 reside near one or more of the faces 102 or 106 of the precast panel 110 or 110*a*. In this regard, the various bars (e.g., the anchor members 140, the fastening members 120, and/or any other suitable objects) can be coupled to the corresponding CRCP 2, the precast panel 110, and/or another precast panel 110*a* in any suitable manner, including, without limitation, by being integrally formed or embedded in such material, by being inserted and bound (e.g., with a binder) into one or more bores 5 in such material, and/or in any other suitable manner.

Once the panels 110 and 110*a* are vertically positioned to a best fit (e.g., by virtue of any suitable jack, leveling material, and/or any other suitable leveling devices AC), the opening 150*b* can be filled with a rapid setting UHPC and/or other suitable binding material so as to encase one or more headed bars (e.g., anchor members 140 and/or fastening members 120) protruding from the existing CRCP 2 and the new precast panel 110. While the embodiment shown in FIG. 5B can (in some cases) simplify panel fabrication and avoid the sensitivity of matching headed bars (e.g., anchor members 140) anchored in the existing CRCP 2 to the corresponding openings 150 cast in the new precast panel 110, such an embodiment can involve sourcing a binder material that will gain strength rapidly enough to open up the corresponding roadway to traffic within an allotted work window.

As another example of a suitable modification, while FIG. 5B shows an embodiment, in which the CRCP 2 has a full-depth saw cut, the ends of the CRCP 2 and the panel can have any suitable shape, including, without limitation, being roughened, angled, forming a tapered space, forming a dove-tail shaped space, and/or having any other suitable shape.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein. Each of the various elements of the described embodiments, implementations, Figures, and examples can be mixed and matched with each other in any suitable manner. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., distal, proximal, front, back, top, bottom, side, up, down, under, over, upper, lower, lateral, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements.

What is claimed is:

1. A pavement patch system comprising:

a precast pavement panel having:

a first end, a second end, a top surface, and a bottom surface;

a first opening defined at the first end of the precast pavement panel such that the first opening opens from at least one of the first end, the bottom surface, and the top surface of the precast pavement panel;

a cross member that extends between the first end and the second end of the precast pavement panel; and a fastening member having a first portion that is anchored within the precast pavement panel and a second portion that extends from the first portion and into the first opening so as to terminate within the first opening; and a piece of continuously reinforced concrete pavement having a first anchor member having a first part that is anchored within the piece of continuously reinforced concrete pavement and having a second part that extends from a first face of the piece of continuously reinforced concrete pavement such that the second part of the first anchor member extends from the piece of continuously reinforced concrete pavement into the first opening so that a length of the second portion of the fastening member and a length of the second part of the first anchor member run adjacent to each other within the first opening so as to be configured to pass at least one of a tension force and a compression force from the piece of continuously reinforced concrete pavement to the cross member.

2. The system of claim 1, wherein the first opening in the precast pavement panel comprises a distal end that is disposed at the first end of the precast pavement panel and a proximal closed end that is disposed closer to a midpoint of a length between the first end and the second end of the precast pavement panel than is the distal end, wherein a length of the first opening runs substantially parallel with respect to a longitudinal axis between the first end and the second end of the precast pavement panel, and wherein a wall of the first opening extending between the distal end and the proximal closed end of the first opening comprises a non-linear portion that is configured to capture a binder that is added to the first opening.

3. The system of claim 1, wherein the precast pavement panel further defines a second opening that opens from the first end, wherein the precast pavement panel comprises an intermediate pavement portion that extends and is disposed between the first opening and the second opening, wherein the precast pavement panel further comprises a strengthening member that is embedded within and that extends through a length of the intermediate pavement portion, between the first opening and the second opening, and wherein a portion of the cross member extends through the intermediate pavement portion, between the first opening and the second opening.

4. The system of claim 3, wherein the strengthening member comprises a distal portion comprising a head and a proximal portion, wherein the distal portion and the head are disposed within the precast pavement panel, closer to the first end than is the proximal portion of the strengthening member.

5. The system of claim 1, wherein the first anchor member comprises a first head that is disposed within the first opening, adjacent to the first end of the precast pavement panel, wherein the fastening member comprises a second head, with the second head being disposed in the first opening, farther from the first end of the precast panel pavement than is the second head such that the first head is configured to direct a shear force in a first direction and the second head is configured to direct an opposing shear force in a second direction.

6. The system of claim 1, wherein the precast pavement panel further comprises a first strengthening member and a second strengthening member that each run alongside of a length of the first opening and along a length of the second portion of the fastening member, wherein the first strengthening member is embedded within concrete that flanks a first side of the first opening, wherein the second strengthening member is embedded within concrete that flanks a second side of the first opening, and wherein a length of the first strengthening member is shorter than a length of the cross member.

7. The system of claim 1, wherein a length of the first opening runs substantially parallel with respect to a longitudinal axis between the first end and the second end of the precast pavement panel, and wherein a wall of the first opening narrows between its upper end and its lower end.

8. The system of claim 1, wherein the piece of continuously reinforced concrete pavement further comprises a second anchor member that is anchored within the piece of continuously reinforced concrete pavement such that a portion of the second anchor member extends from the first face of the piece of continuously reinforced concrete pavement so that the first and second anchor members extend from the piece of continuously reinforced pavement into the first opening so as to be disposed adjacent to a length of the second portion of the fastening member, such that a portion of the length of the second portion of the fastening member is disposed between the first and second anchor members, and such that the portion of the length of the second portion of the fastening member is configured to direct a shear force in a first direction and such that the first and second anchor members are each configured to direct an opposing shear force in a second direction that overlaps with the first direction.

9. The system of claim 8, wherein the first anchor member, the second anchor member, and the fastening member each comprise an enlarged head that is disposed within the first opening, and wherein the enlarged head of the fastening member is disposed closer to the first end of the precast pavement panel that is the enlarged head of the first anchor member and the second anchor member.

10. A pavement patch system comprising:

a precast pavement panel having:

a first end, a second end that is disposed substantially opposite to the first end, a top surface, and a bottom surface;

a plurality of cross members that are embedded within, and that extend between the first end and the second end of, the precast pavement panel;

a first opening defined in the precast pavement panel such that the first opening opens from the first end and from at least one of the bottom surface and the top surface of the precast pavement panel;

a fastening member having a first portion that is anchored within the precast pavement panel and a second portion that extends from the first portion into the first opening, wherein the second portion comprises a first enlarged head that is disposed in the first opening, adjacent to the first end of the precast pavement panel; and a piece of continuously reinforced concrete pavement having a first anchor member that is anchored within the piece of continuously reinforced concrete pavement and that extends from a first face of the piece of continuously reinforced concrete pavement so that a portion of the first anchor member extends from the piece of continuously reinforced concrete pavement into the first opening and runs adjacent to the second portion of the fastening member, wherein the portion of the first anchor member that extends from the piece of continuously reinforced concrete pavement into the first opening comprises a second enlarged head that is disposed within the opening, farther from the first end of the precast panel pavement than is the first enlarged head such that the first enlarged head is configured to direct a shear force in a first direction and the second enlarged head is configured to direct an opposing shear force in a second direction that overlaps with the first direction.

11. The system of claim 10, further comprising a device that is coupled to at least one of the: (a) precast pavement panel and (b) the piece of continuously reinforced concrete to selectively vary at least one of: (i) an amount of tension and (ii) an amount of compression between the precast pavement panel and the piece of continuously reinforced concrete pavement.

12. The system of claim 10, wherein the first opening in the precast pavement panel comprises a distal end that is disposed at the first end of the precast pavement panel and a proximal closed end that is disposed closer to a midpoint of a length between the first end and the second end of the precast pavement panel than is the distal end, and wherein a sidewall of the first opening extending between the distal end and the proximal closed end of the first opening comprises a non-linear wall portion that is configured to receive a binder that is added to the first opening.

13. The system of claim 10, wherein the precast pavement panel further comprises a first strengthening member and a second strengthening member that are each embedded within the precast pavement panel so as to run adjacent to, and to flank, an opposite side of the first opening, wherein the first and second strengthening members each having a distal end with an enlarged head and a proximal end, and wherein the distal end with the enlarged head is disposed closer to the first end of the precast pavement panel than is the proximal end.

14. The system of claim 13, wherein the precast pavement panel further defines a second opening that opens from the first end and the bottom surface of the precast pavement panel, wherein an intermediate pavement portion is disposed between the first and second openings, and wherein a portion of a first strengthening member, a portion of the second strengthening member, and a portion of one of the cross members are each embedded within the intermediate pavement portion so as to be disposed between a portion of the first opening and a portion of the second opening.

15. A method for patching pavement, the method comprising:

providing a precast pavement panel having:

a first end, a second end, a top surface, and a bottom surface;

a first opening defined at the first end of the precast pavement panel such that the first opening opens from at least one of the first end, the bottom surface, and the top surface of the precast pavement panel;

a cross member that extends between the first end and the second end of the precast pavement panel; and a fastening member having a first portion that is anchored within the precast pavement panel and a second portion that extends from the first portion and into the first opening so as to terminate within the first opening;

placing the precast pavement panel next to a piece of continuously reinforced concrete pavement having a first anchor member having a first part that is anchored within the piece of continuously reinforced concrete pavement and having a second part that extends from a first face of the piece of continuously reinforced concrete pavement; and coupling the precast pavement panel with the piece of continuously reinforced concrete pavement such that the second part of the first anchor member extends from the piece of continuously reinforced concrete pavement into the first opening so that a length of the second portion of the fastening member and a length of the second part of the first anchor member run adjacent to each other within the first opening so as to be configured pass at least one of a tension force and a compression force from the piece of continuously reinforced concrete pavement to the cross member.

16. The method of claim 15, further comprising using a compression device to selectively apply pressure between the precast pavement panel and the piece of continuously reinforced concrete pavement, and placing a binder in the first opening to couple the precast pavement panel to the piece of continuously reinforced concrete pavement.

17. The method of claim 15, further comprising using a tensioning device to selectively apply tension between the precast pavement panel and the piece of continuously reinforced concrete pavement, and placing a binder between the precast pavement panel and the piece of continuously reinforced concrete pavement.

18. A method for patching pavement, the method comprising:

providing a precast pavement panel having:

a first end, a second end that is disposed substantially opposite to the first end, a top surface, and a bottom surface;

a plurality of cross members that are embedded within, and that extend between the first end and the second end of, the precast pavement panel; and a first opening defined in the precast pavement panel such that the first opening opens from the first end and from at least one of the bottom surface and the top surface of the precast pavement panel; and a fastening member having a first portion that is anchored within the precast pavement panel and a second portion that extends from the first portion into the first opening, wherein the second portion comprises a first enlarged head that is disposed within the first opening, adjacent to the first end of the precast pavement panel;

obtaining a piece of continuously reinforced concrete pavement having a first anchor member that is anchored within the piece of continuously reinforced concrete pavement and that extends from a first face of the piece of continuously reinforced concrete pavement;

aligning the first end of the precast pavement panel with the first face of the piece of continuously reinforced concrete pavement such that a portion of the first anchor member extends from the piece of continuously reinforced concrete pavement into the first opening and runs adjacent to the second portion of the fastening member, wherein the portion of the first anchor member that extends from the piece of continuously reinforced concrete pavement into the first opening comprises a second enlarged head that is disposed within the first opening, farther from the first end of the precast panel pavement than is the first enlarged head such that the first enlarged head is configured to direct a shear force in a first direction and the second enlarged head is configured to direct an opposing shear force in a second direction that overlaps with the first direction; and applying a binder into the first opening to bind the precast pavement panel with the piece of continuously reinforced concrete pavement.

19. A road patch system comprising:

a precast pavement panel having:

a first end, a second end, a first surface, and a second surface, the second surface being opposite to the first surface and the second end being substantially opposite to the first end, with at least one of the first surface and the second surface comprising a first driving surface for contacting and supporting traffic;

a cross member that extends between the first end and the second end of the precast pavement panel;

a first elongated opening that opens from the first surface and the first end of the precast pavement panel, the first elongated opening having a first expanded portion; and a first strengthening member and a second strengthening member that are each shorter than the cross member, wherein the first strengthening member extends along a first side of the first elongated opening, and wherein the second strengthening member extends along a second side of the first opening;

a piece of continuously reinforced concrete pavement having:

a first side, a first face, and a second face, with the first face of the continuously reinforced concrete pavement and the first end of the precast pavement panel forming a transverse joint that runs transverse to a length between the first end and the second end of the precast pavement panel, and with at least one of the first face and the second face comprising the driving surface; and a second elongated opening that opens from the first side and the first face of the piece of pavement, the second elongated opening having a second expanded portion; and a double headed anchor that is disposed in the first and second elongated openings so as to extend across the transverse joint and such that a first head of the double headed anchor is disposed in the first expanded portion and a second head of the double headed anchor is disposed in the second expanded portion.

20. A road patch comprising:

a precast pavement panel having:

a first end, a second end, a top surface, and a bottom surface;

a first opening and a second opening that are each defined at the first end of the precast pavement panel such that the first and second openings each comprise a distal end that opens from the first end of the precast pavement panel and a closed end that is disposed closer to a center between the first and second ends of the precast pavement panel than is the distal end of the first and second openings;

a cross member that extends between the first end and the second end of the precast pavement panel, with an end of the cross member extending between the first and second openings such that the end of the cross member is disposed in concrete of the precast pavement panel, between the first and second openings and adjacent to the first end of the precast pavement panel; and a first strengthening member having a first part with a first enlarged head, the first enlarged head being disposed in the concrete of the precast pavement panel that is disposed between the first and second openings and adjacent to the first end of the precast pavement panel with a length of the first strengthening member running alongside the first opening, with a second part of the first strengthening member extending from the first part so as to be disposed closer to the center of the precast panel than is the first part of the first strengthening member, and with the first strengthening member being shorter than the cross member.

21. The road patch of claim 20, further comprising a second strengthening member with a second enlarged head, with the second head being disposed adjacent to the first end of the precast pavement panel and with the first and second strengthening members each being disposed on opposite sides of the first opening.

22. The road patch of claim 20, further comprising a piece of continuously reinforced concrete pavement that has an anchor member with a first portion of the anchor member being anchored within the piece of continuously reinforced concrete pavement and a second portion that extends from the piece of continuously reinforced concrete pavement, with the second portion of the anchor member having a second enlarged head that is disposed within the opening, such that when a binder is disposed in the opening, the first enlarged head is configured to direct a shear force in a first direction and the second enlarged head is configured to direct an opposing shear force in a second direction that overlaps with the first direction.

* * * * *